US007469752B2

(12) United States Patent
Furusawa et al.

(10) Patent No.: US 7,469,752 B2
(45) Date of Patent: Dec. 30, 2008

(54) POWER TOOL

(75) Inventors: Masanori Furusawa, Anjo (JP); Yoshihiro Kasuya, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 11/604,201

(22) Filed: Nov. 27, 2006

(65) Prior Publication Data

US 2007/0125563 A1 Jun. 7, 2007

(30) Foreign Application Priority Data

Dec. 2, 2005 (JP) ..... 2005-349868
Dec. 12, 2005 (JP) ..... 2005-358308
Jan. 27, 2006 (JP) ..... 2006-018991

(51) Int. Cl.
*B25D 16/00* (2006.01)

(52) U.S. Cl. ..... 173/48; 173/170; 173/217

(58) Field of Classification Search ..... 173/48, 173/105, 109, 112, 200, 201, 217; 310/47, 310/50

See application file for complete search history.

(56) References Cited

U.S. PATENT DOCUMENTS 3,774,699 A * 11/1973 Schmuck ..... 173/48
3,828,865 A * 8/1974 Schnizler, Jr. ..... 173/48
4,732,218 A * 3/1988 Neumaier et al. ..... 173/105
4,763,733 A * 8/1988 Neumaier ..... 173/48
4,998,588 A * 3/1991 Manschitz ..... 173/47
5,456,324 A * 10/1995 Takagi et al. ..... 173/48
6,510,903 B2 * 1/2003 Funfer ..... 173/48
6,557,648 B2 * 5/2003 Ichijyou et al. ..... 173/48
6,619,149 B2 * 9/2003 Funfer ..... 74/329
6,712,156 B2 * 3/2004 Funfer ..... 173/48
6,763,897 B2 * 7/2004 Hanke et al. ..... 173/210
7,174,969 B2 * 2/2007 Droste ..... 173/48
7,306,049 B2 * 12/2007 Soika et al. ..... 173/49
7,320,368 B2 * 1/2008 Watanabe ..... 173/48
7,322,427 B2 * 1/2008 Shimma et al. ..... 173/48
2006/0076154 A1 4/2006 Aoki

FOREIGN PATENT DOCUMENTS

DE 197 16 976 A1 10/1998
GB 2 324 491 A 10/1998
JP A 2004-299036 10/2004

* cited by examiner

*Primary Examiner*—Paul R Durand
(74) *Attorney, Agent, or Firm*—Oliff & Berridge, PLC

(57) ABSTRACT

It is an object of the invention to provide a power tool having a rational structure. A representative power tool is provided to have a tool bit a power tool body, a motion converting mechanism housing chamber, a motion converting mechanism and a clutch mechanism. The power tool further includes a switching member, an opening, a rotating member, a switching operation transmitting mechanism and an actuating member. The switching member is disposed on an upper surface of the power tool body and can be manually operated by a user. The opening is provided to connect the motion converting mechanism housing chamber and the outside. The rotating member can rotate while closing the opening. The switching operation transmitting mechanism is disposed outside the motion converting mechanism housing chamber to connect the switching member to the rotating member and to transmit the switching operation effected by the user's manual operation of the switching member to the rotating member. The rotating member includes the actuating member that extends into the motion converting mechanism housing chamber to switch the clutch mechanism between the power transmission state and the power transmission interrupted state.

9 Claims, 18 Drawing Sheets

POWER TOOL

BACKGROUND OF THE INVENTION

1. Field of Invention

The present invention relates to a power tool having a tool bit that performs a predetermined operation by linearly moving in its axial direction.

2. Description of the Related Art

German Patent Publication No. 19716976 discloses a hammer drill including a crank mechanism and a clutch mechanism within a motion converting mechanism housing chamber. The clutch mechanism is switched between a power transmission state to activate the crank mechanism and a power transmission interrupted state not to activate the crank mechanism by manually operating a clutch switching member. The clutch switching member is disposed on the upper surface of the power tool body in order to enhance an operability of the power tool.

As to the motion converting mechanism housing chamber, lubrication is necessarily required for the crank mechanism and the clutch mechanism. In this connection, the total volume of the motion converting mechanism housing chamber should preferably be minimized in order to enhance the efficiency of the lubrication. Thus, it is necessary to take both the disposition of the clutch switching member and the structure of the motion converting mechanism housing chamber into account when designing the inner structure of the power tool.

SUMMARY OF THE INVENTION

Accordingly, it is an object of the present invention to provide a power tool having a rational structure.

The above-described problem can be solved by the features of claimed invention. According to the invention, a representative power tool is provided to have a tool bit that performs a predetermined operation by linearly moving in its axial direction. The "power tool" according to this invention typically includes an impact tool such as an electric hammer in which a tool bit performs axial striking movement or a hammer drill in which a tool bit performs axial striking movement and rotation on the axis. The power tool also suitably includes any power tool of the type in which a tool bit linearly moves in the axial direction.

The power tool of the present invention includes a power tool body, a motion converting mechanism housing chamber, a motion converting mechanism and a clutch mechanism for the motion converting mechanism. The motion converting mechanism housing chamber is formed within the power tool body. Preferably, the motion converting mechanism housing chamber is hermetically closed and filled with lubricant for lubricating the mechanisms disposed within the motion converting mechanism housing chamber. The motion converting mechanism is disposed within the motion converting mechanism housing chamber and linearly moves the tool bit. The clutch mechanism for the motion converting mechanism is disposed within the motion converting mechanism housing chamber and switched between a power transmission state in which a driving force is transmitted to the motion converting mechanism and a power transmission interrupted state in which transmission of the driving force is interrupted.

The power tool of this invention includes a switching member, an opening, a rotating member, a switching operation transmitting mechanism and an actuating member. The switching member is disposed on an upper surface of the power tool body and can be manually operated by a user to switch the operating state of the clutch mechanism. The opening is provided to connect the motion converting mechanism housing chamber and the outside. The rotating member can rotate while closing the opening. The switching operation transmitting mechanism is disposed outside the motion converting mechanism housing chamber to connect the switching member to the rotating member and to transmit the switching operation effected by the user's manual operation of the switching member to the rotating member. The rotating member includes the actuating member that extends into the motion converting mechanism housing chamber, and the actuating member switches the clutch mechanism between the power transmission state and the power transmission interrupted state by utilizing rotation of the rotating member.

According to this invention, with the construction in which the switching member is disposed on the upper surface of the power tool body, the switching member can be easily operated by the user whether right-handed or left-handed. Further, with the construction in which the switching operation transmitting member is disposed outside the motion converting mechanism housing chamber, the capacity of the motion converting mechanism housing chamber can be reduced by the capacity for housing the switching operation transmitting mechanism. As a result, lubricant can be more readily supplied to the mechanisms disposed within the motion converting mechanism housing chamber, so that the lubricating effect can be enhanced.

Further, with the construction in which the clutch mechanism is switched by utilizing rotation of the rotating member, the opening can be held closed by the rotating member. Therefore, even in the construction in which the switching operation transmitting mechanism is disposed outside the motion converting mechanism housing chamber, switching of the clutch mechanism can be efficiently effected while avoiding the lubricant from leaking out of the motion converting mechanism housing chamber through the opening.

Thus, according to this invention, utilizing the advantage of placement of the switching member on the upper surface of the power tool body, the capacity of the motion converting mechanism housing chamber can be reduced while preventing lubricant from leaking out of the motion converting mechanism housing chamber, so that the lubricity of the mechanisms within the motion converting mechanism housing chamber can be enhanced.

Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Representative Embodiment

Figure 1:
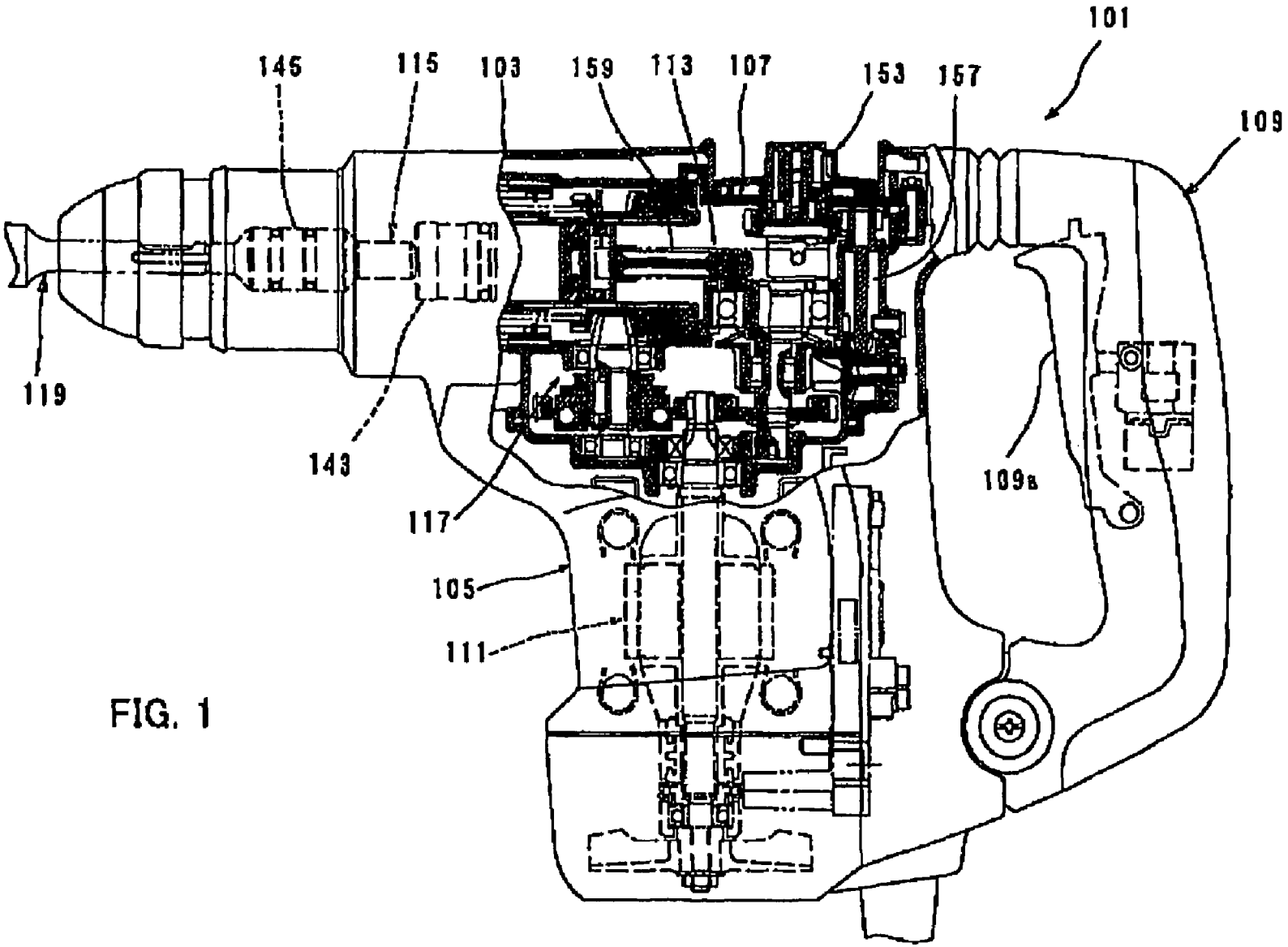
FIG. 1 is a sectional side view schematically showing an entire hammer drill according to a first representative embodiment of the invention.

A first representative embodiment of the present invention will now be described with reference to FIGS. 1 to 10. FIG. 1 is a sectional side view showing an entire electric hammer drill 101 as a representative embodiment of the power impact tool according to the present invention. As shown in FIG. 1, the hammer drill 101 of this embodiment includes a body 103, a hammer bit 119 detachably coupled to the tip end region (on the left side as viewed in FIG. 1) of the body 103 via a hollow tool holder (not shown), and a handgrip 109 that is held by a user and connected to the body 103 on the side opposite to the hammer bit 119. The hammer bit 119 is held by the tool holder such that it is allowed to reciprocate with respect to the tool holder in its axial direction and prevented from rotating with respect to the tool holder in its circumferential direction. The hammer bit 119 is a feature that corresponds to the "tool bit" according to the present invention. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a motion changing mechanism 131, a striking mechanism 115 and a power transmitting mechanism 117. The motion changing mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. Further, the speed of the rotating output of the driving motor 111 is appropriately reduced by the power to transmitting mechanism 117 and then transmitted to the hammer bit 119. As a result, the hammer bit 119 is caused to rotate in the circumferential direction. The driving motor 111 is driven when a trigger 109*a* on the handgrip 109 is depressed.

Figure 2:
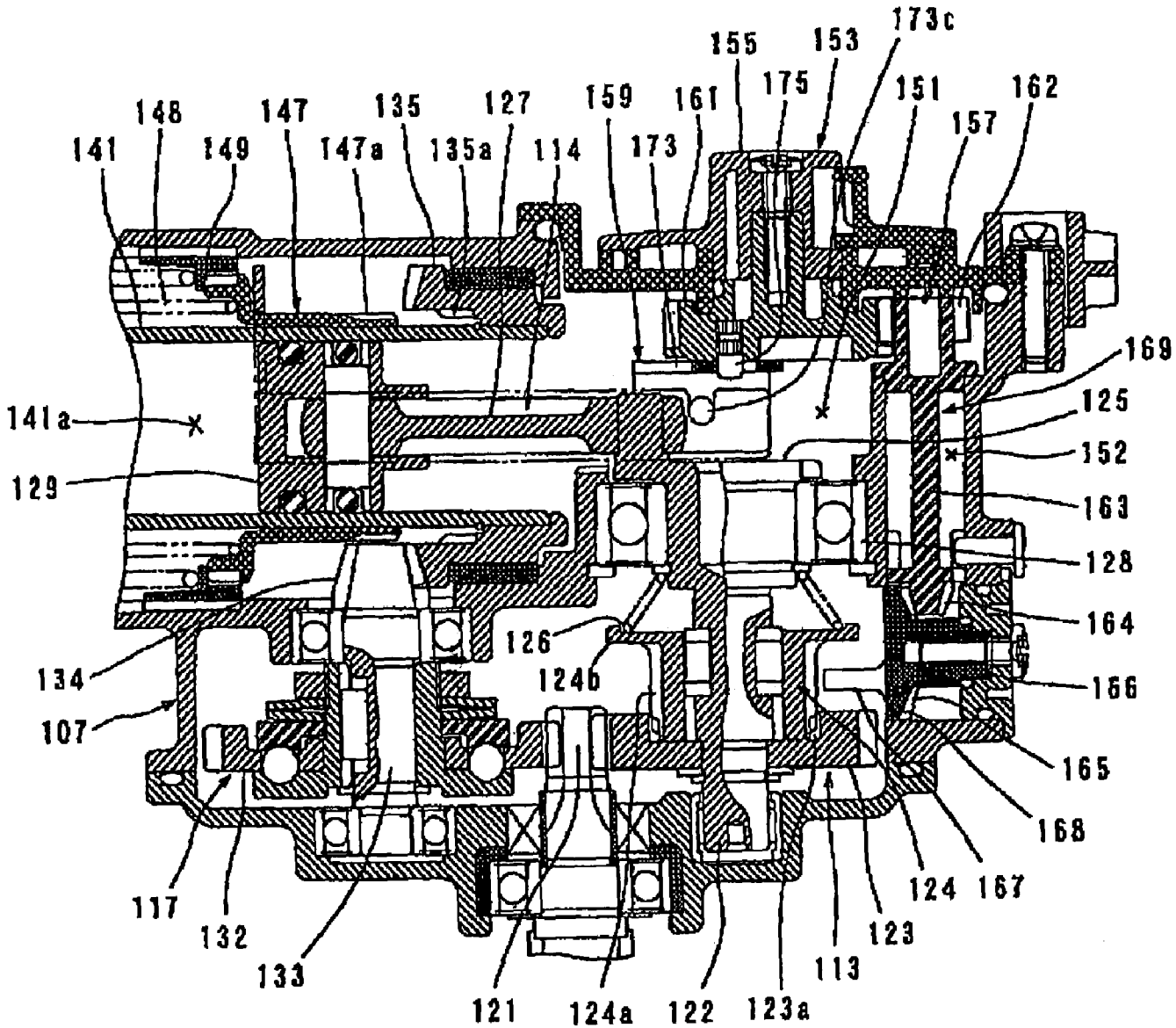
FIG. 2 is a sectional side view of an essential part of the hammer drill in hammer mode.
Figure 3:
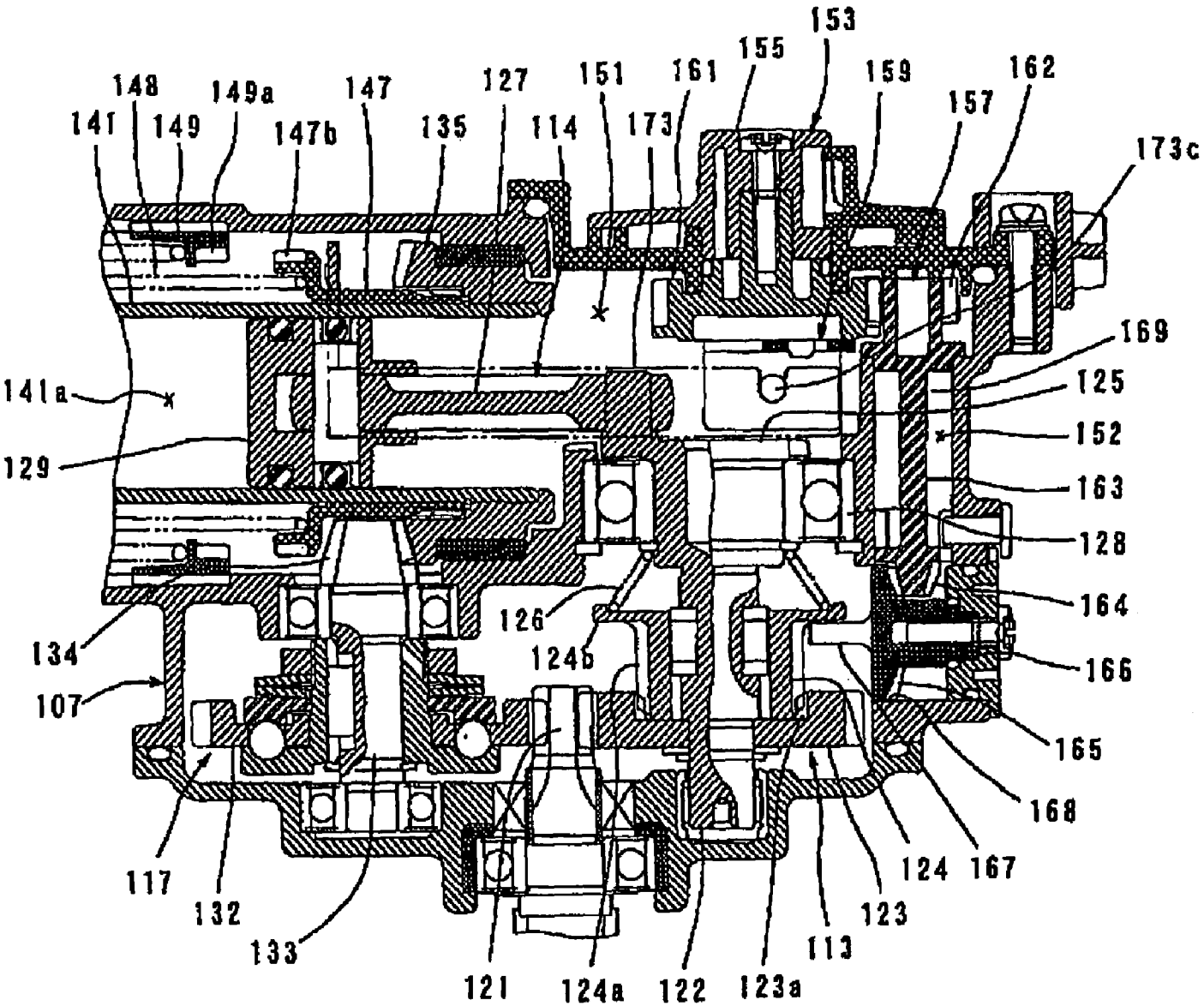
FIG. 3 is a sectional side view of the essential part of the hammer drill in hammer drill mode.
Figure 4:
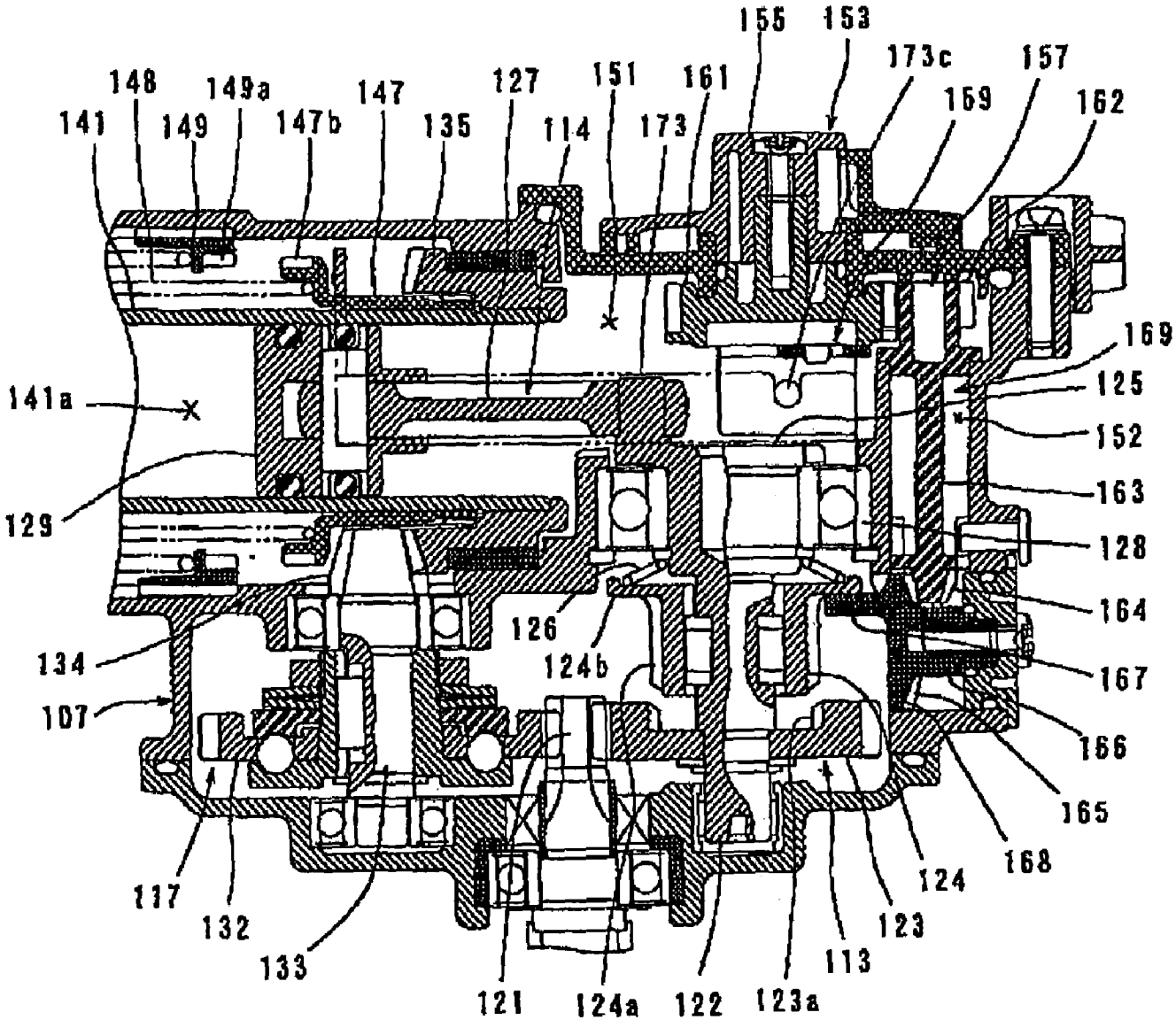
FIG. 4 is a sectional side view of the essential part of the hammer drill in drill mode.

FIGS. 2 to 4 show an essential part of the hammer drill 101 in enlarged sectional view. The motion changing mechanism 113 includes a driving gear 121 that is rotated in a horizontal plane by the driving motor 111, a driven gear 123, a crank shaft 122, a crank plate 125, a crank arm 127 and a driving element in the form of a piston 129. The crank shaft 122, the crank plate 125, the crank arm 127 and the piston 129 form a crank mechanism 114. The piston 129 is slidably disposed within the cylinder 141 and reciprocates along the cylinder 141 when the driving motor 111 is driven.

The crank shaft 122 is disposed such that its longitudinal direction is a vertical direction crossing the axial direction of the hammer bit 119. A clutch member 124 is disposed between the crank shaft 122 and the driven gear 123. The clutch member 124 has a cylindrical shape and has a flange 124*b* extending outward from one axial end (upper end) of the clutch member 124. The clutch member 124 is mounted on the crank shaft 122 such that the clutch member 124 can move in the longitudinal direction with respect to the crank shaft 122 and rotate together in the circumferential direction. The clutch member 124 further has clutch teeth 124*a* on the outer periphery. The driven gear 123 has a circular recess and clutch teeth 123*a* are formed in the inner circumferential surface of the circular recess. The teeth 124*a* of the clutch member 124 are engaged with and disengaged from the clutch teeth 123*a* of the driven gear 123 when the clutch member 124 moves on the crank shaft 122 in the longitudinal direction. In other words, the clutch member 124 can be switched between a power transmission state (see FIGS. 2 and 3) in which the driving force of the driven gear 123 is transmitted to the crank shaft 122 and a power transmission interrupted state (see FIG. 4) in which such transmission of the driving force is interrupted. The clutch member 124 is normally biased by a biasing spring 126 in the direction of engagement between the clutch teeth 124*a* and the clutch teeth 123*a* of the driven gear 123.

The striking mechanism 115 includes a striker 143 and an impact bolt 145 (see FIG. 1). The striker 143 is slidably disposed within the bore of the cylinder 141. The impact bolt 145 is slidably disposed within the tool holder and serves as an intermediate element to transmit the kinetic energy of the striker 143 to the hammer bit 119. The striker 143 is driven via the action of an air spring of an air chamber 141*a* of the cylinder 141 which is caused by sliding movement of the piston 129. The striker 143 then collides with (strikes) the impact bolt 145 that is slidably disposed within the tool holder, and transmits the striking force to the hammer bit 119 via the impact bolt 145.

The power transmitting mechanism 117 includes an intermediate gear 132 that engages with the driving gear 121, an intermediate shaft 133 that rotates together with the intermediate gear 132, a small bevel gear 134 that is caused to rotate in a horizontal plane together with the intermediate shaft 133, a large bevel gear 135 that engages with the small bevel gear 134 and rotates in a vertical plane, and a slide sleeve 147 that engages with the large bevel gear 135 and is caused to rotate. The rotation driving force of the slide sleeve 147 is transmitted to the tool holder via the cylinder 141 which rotates together with the slide sleeve 147, and then further transmitted to the hammer bit 119 held by the tool holder. The slide sleeve 147 can move with respect to the cylinder 141 in the axial direction of the hammer bit and rotates together with the cylinder 141 in the circumferential direction.

The slide sleeve 147 forms a clutch mechanism in the power transmitting mechanism 117. Clutch teeth 147*a* are formed on the outer periphery of one longitudinal end portion of the slide sleeve 147 and engage with clutch teeth 135*a* of the large bevel gear 135 when the slide sleeve 147 moves rearward (toward the handgrip) with respect to the cylinder 141. Such engagement is released when the slide sleeve 147 moves forward (toward the hammer bit) with respect to the cylinder 141. In other words, the slide sleeve 147 can be switched between a power transmission state (see FIGS. 3 and 4) in which the rotation driving force of the large bevel gear 135 is transmitted to the cylinder 141 and a power transmission interrupted state (see FIG. 2) in which such transmission of the driving force is interrupted. The slide sleeve 147 is normally biased by a biasing spring 148 in the direction of engagement between the clutch teeth 147*a* and the clutch teeth 135*a* of the large bevel gear 135.

Further, rotation locking teeth 147*b* are formed on the other longitudinal end (forward end) of the slide sleeve 147. When the slide sleeve 147 is caused to move forward and switched to the power transmission interrupted state (when the hammer bit 119 is driven in the hammer mode), the teeth 147*b* of the slide sleeve 147 engage with teeth 149*a* of a lock ring 149 that is locked in the circumferential direction with respect to the gear housing 107. As a result, the cylinder 141, the tool holder and the hammer bit 119 can be locked against free movement in the circumferential direction ("variolock").

The motion changing mechanic 113 and the power switching mechanism 117 are housed within a crank chamber 151 or the inside space of the gear housing 107. Sliding parts are lubricated by lubricant (grease) filled in the crank chamber 151.

A mode switching mechanism 153 for switching between driving modes of the hammer bit 119 will now be explained with reference to FIGS. 2 to 10. The mode switching mechanism 153 can be switched among a hammer mode in which the hammer bit 119 is caused to perform only striking movement, a hammer drill mode in which the hammer bit 119 is caused to perform both the striking movement and rotation, and a drill mode in which the hammer bit 119 is caused to perform only rotation.

Figure 5:
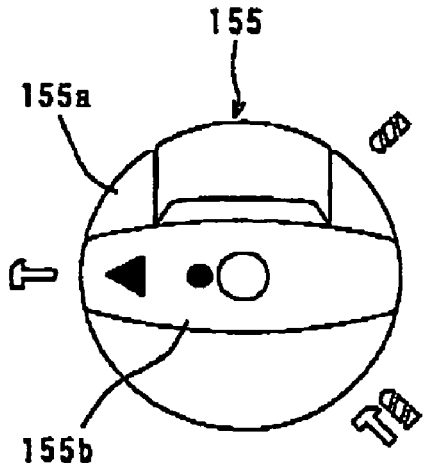
FIG. 5 is a plan view showing a mode switching member in the hammer mode.
Figure 6:
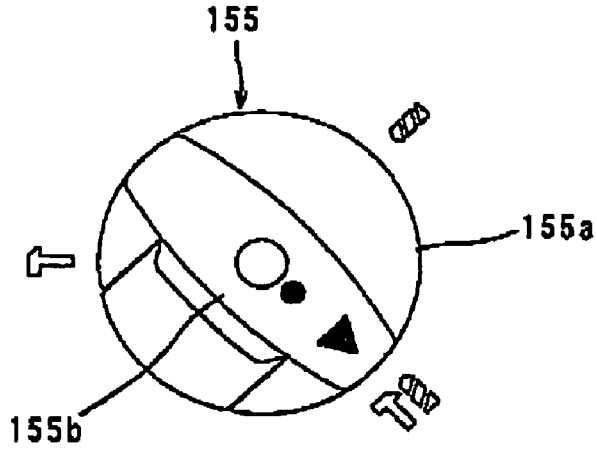
FIG. 6 is a plan view showing the mode switching member in the hammer drill mode.
Figure 7:
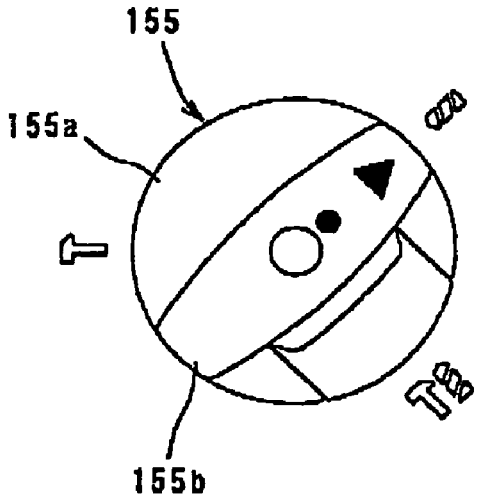
FIG. 7 is a plan view showing the mode switching member in the drill mode.

As shown in FIGS. 2 to 4, the mode switching mechanism 153 mainly includes a mode switching member 155, a first switching mechanism 157 that switches the clutch member 124 of the crank mechanism 114 according to the switching operation of the mode switching member 155, and a second switching mechanism 159 that switches the slide sleeve 147 of the power transmitting mechanism 117. The mode switching member 155 is a feature that corresponds to the "switching member" according to this invention. The mode switching member 155 is mounted externally on the upper surface of the gear housing 107. In other words, the mode switching member 155 is disposed above the crank mechanism 114. As shown in FIGS. 5 to 7, the mode switching member 155 includes a disc 155*a* with an operating grip 155*b* and is mounted on the gear housing 107 such that it can be turned in a horizontal plane. The three mode positions, i.e. hammer mode position, hammer drill mode position, and drill mode position, are marked on the gear housing 107 at 120° intervals in the circumferential direction of the disc 155*a*. The mode switching member 155 can be switched to a desired mode position by placing the pointer of the operating grip 155*b* on the appropriate mark. FIG. 5 shows the mode switching member 155 placed in the hammer mode position, FIG. 6 shows it in the hammer drill mode position, and FIG. 7 shows it in the drill mode position.

The first switching mechanism 157 is constructed such that switching of the clutch member 124 of the crank mechanism 114 is effected by revolution (eccentric revolution) of a first eccentric pin 167 on the axis of rotation of a rotating member 166 when the mode switching member 155 is turned for mode change. The first switching mechanism 157 mainly includes a first gear 161, a second gear 162, a rotation transmitting shaft 163, a third gear 164, a fourth gear 165, the rotating member 166 and the first eccentric pin 167.

The first gear 161 rotates in a horizontal plane together with the mode switching member 155 when the mode switching member 155 is turned in a horizontal plane. The second gear 162 is integrally formed on one longitudinal end portion (upper end portion) of the rotation transmitting shaft 163 and engages with the first gear 161. The rotation transmitting shaft 163 is disposed vertically such that its longitudinal direction is parallel to the longitudinal direction of the crank shaft 122. The third gear 164 is integrally formed on the other longitudinal end portion (lower end portion) of the rotation transmitting shaft 163 and engages with the fourth gear 165. The fourth gear 165 is integrally formed on the rotating member 166. The rotating member 166 is horizontally disposed below the rotation transmitting shaft 163 such that its longitudinal direction is perpendicular to the rotation transmitting shaft 163. Each of third and fourth gears 164, 165 comprises a bevel gear and engages with the other.

When the mode switching member 155 is turned, the rotation transmitting shaft 163 rotates in a horizontal plane via the first and second gears 161, 162. The rotation of the rotation transmitting shaft 163 is further transmitted as rotation in a vertical plane to the rotating member 166 via the third and fourth gears 164, 165. The first eccentric pin 167 is provided on the axial end surface of the rotating member 166 and disposed in a position displaced a predetermined distance from the axis of rotation of the rotating member 166. The first eccentric pin 167 is disposed to face the underside of the flange 124*b* of the clutch member 124. Therefore, when the rotating member 166 rotates in a vertical plane and thus the first eccentric pin 167 eccentrically revolves on the axis of rotation of the rotating member 166, the first eccentric pin 167 vertically moves the clutch member 124 along the crank shaft 122 while engaging with the flange 124*b* of the clutch member 124 by its vertical components (components in the longitudinal direction of the crank shaft 122) of the revolving movement. In this manner, the first eccentric pin 167 moves the clutch member 124 between the power transmission position and the power transmission interrupted position. The first gear 161, the second gear 162, the rotation transmitting shaft 163, the third gear 164 and the fourth gear 165 form a switching operation transmitting mechanism 169. The first eccentric pin 167 is a feature that corresponds to the "actuating member" according to this invention.

The first and second gears 161, 162 of the first switching mechanism 157 are disposed within the crank chamber 151, while the rotation transmitting shaft 163, the third gear 164, the fourth gear 165 and the rotating member 166 of the first switching mechanism 157 are disposed outside the crank chamber 151. Specifically, a housing space 152 for housing the switching operation transmitting mechanism 169 is provided within the gear housing 107 and houses the rotation transmitting shaft 163, the third gear 164, the fourth gear 165 and the rotating member 166. The housing space 152 is a feature that corresponds to the "outside" according to this invention. The housing space 152 communicates with the crank chamber 151 via a circular opening 168. The rotating member 166 is disposed such that a circular periphery of the rotating member 166 is closely fitted in the opening 168 in such a manner as to close the opening 168 and the rotating member 166 can rotate in this state. The first eccentric pin 167 is disposed to generally horizontally extend into the crank chamber 151 via the opening 168 and to face the underside of the flange 124*b* of the clutch member 124.

When the mode switching member 155 is turned to the hammer mode position or the hammer drill mode position, as shown in FIGS. 2 and 3, the first eccentric pin 167 is moved to a position on the same level as or below the axis of rotation of the rotating member 166 in the vertical direction. At this time, the clutch member 124 is moved downward by the biasing spring 126 and the clutch teeth 124*a* engage with the clutch teeth 123*a* of the driven gear 123. Thus, the clutch member 124 is switched to the power transmission state. On the other hand, when the mode switching member 155 is turned to the drill mode position, as shown in FIG. 4, the first eccentric pin 167 is moved to a position higher than the axis of rotation of the rotating member 166 in the vertical direction. At this time, the clutch member 124 is moved upward by the first eccentric pin 167 against the biasing force of the biasing spring 126 and thus the engagement between the teeth 124*a*, 123*a* is released. Thus, the clutch member 124 is switched to the power transmission interrupted state.

The second switching mechanism 159 will now be explained with reference to FIGS. 8 to 10. The second switching mechanism 159 is constructed such that switching of the slide sleeve 147 of the power transmitting mechanism 117 is effected by linear motion of a generally U-shaped frame member 173 in the longitudinal direction of the cylinder 141. The second switching mechanism 159 mainly includes the frame member 173 that is generally U-shape in plan view and disposed within the crank chamber 151. The frame member 173 is a feature that corresponds to the "clutch switching mechanism" according to this invention.

Figure 8:
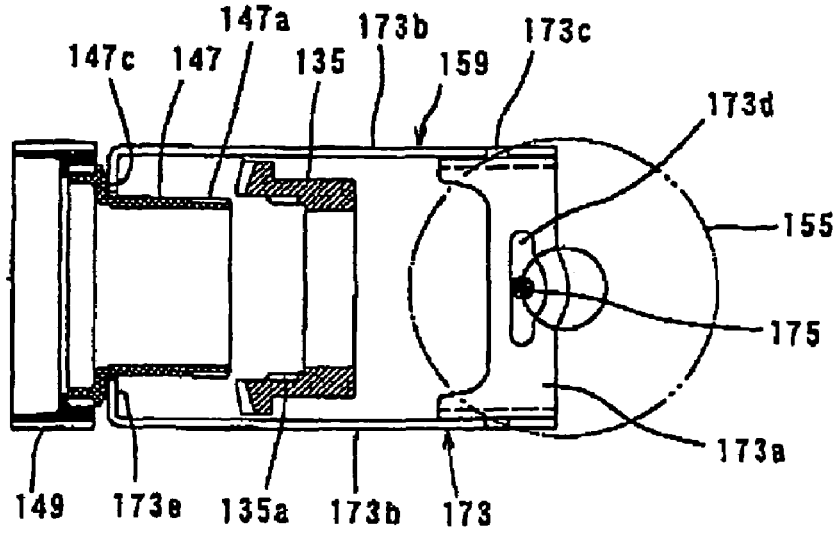
FIG. 8 is a sectional plan view showing a second switching mechanism in the hammer mode.
Figure 9:
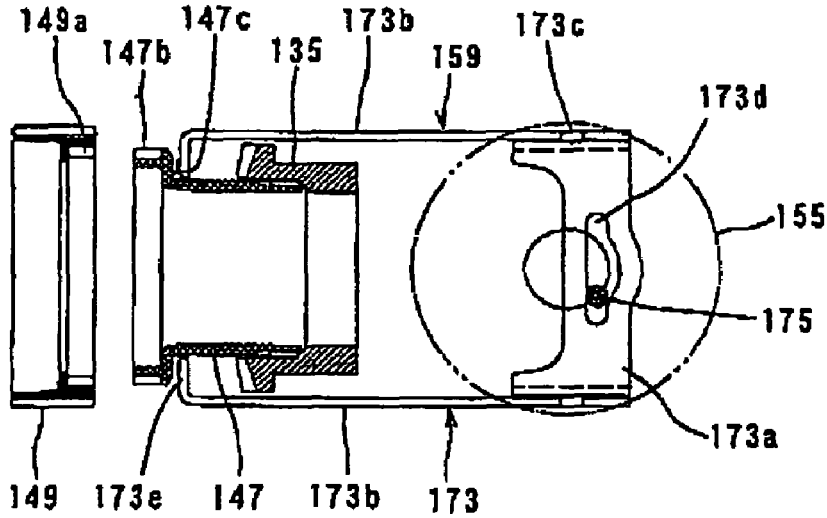
FIG. 9 is a sectional plan view showing the second switching mechanism in the hammer drill mode.
Figure 10:
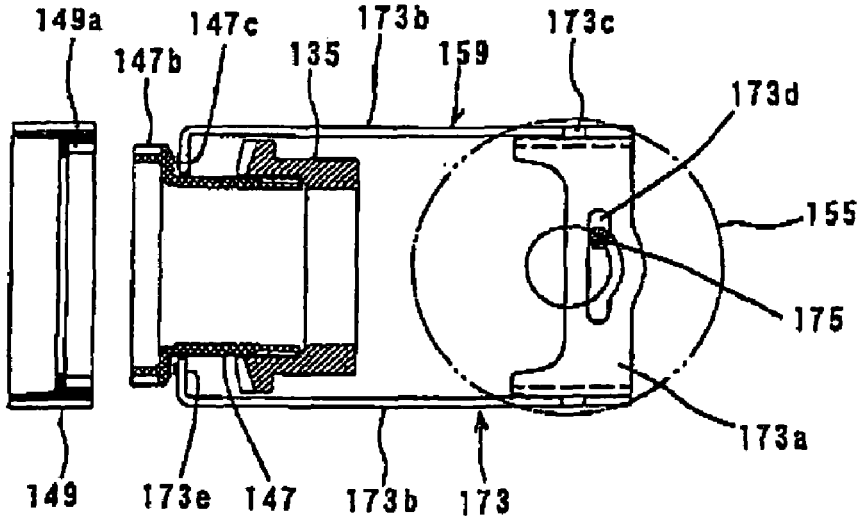
FIG. 10 is a sectional plan view showing the second switching mechanism in the drill mode.

As shown in FIGS. 8 to 10, the frame member 173 includes a base 173*a* which extends horizontally in a direction crossing the longitudinal direction of the cylinder 141, and two legs 173*b* which extend horizontally in the longitudinal direction of the cylinder 141 through the space outside the large bevel gear 135. The base 173*a* has connecting pins 173*c* on the both ends in the extending direction, and the connecting pins 173*c* are engaged in recesses of the legs 173*b*. Thus, the base 173*a* and the legs 173*b* moves together in the longitudinal direction of the cylinder 141. An oblong hole 173*d* is formed in the base 173*a* of the frame member 173 and engages with a second eccentric pin 175 (shown in cross section in FIGS. 8 to 10). The second eccentric pin 175 is provided on the underside of the first gear 161 of the first switching mechanism 157 and disposed in a position displaced a predetermined distance from the axis of rotation of the first gear 161. Therefore, when the second eccentric pin 175 revolves on the axis of rotation of the first gear 161, the second eccentric pin 175 moves the frame member 173 in the longitudinal direction of the cylinder 141 by its longitudinal components (components in the longitudinal direction of the cylinder 141) of the revolving movement.

When the mode switching member 155 is actuated, the frame member 173 is linearly moved in the longitudinal direction of the cylinder 141 by the second eccentric pin 175 engaged with the oblong hole 173*c*. The legs 173*b* extend through the region outside the large bevel gear 135, and ends of the legs 173*b* in the extending direction reach the outside of the slide sleeve 147. An engagement end 173*e* is formed on the end of each of the legs 173*b* in the extending direction and can engage with a stepped portion 147*c* of the slide sleeve 147 in the extending direction. The engagement end 173*e* is formed by bending the end of the leg 173*b* inward (toward the slide sleeve 147).

When the mode switching member 155 is turned to the hammer mode position, as shown in FIGS. 2 and 8, the frame member 173 is moved forward (leftward as viewed in the drawing) by the second eccentric pin 175 and pushes the stepped portion 147*c* of the slide sleeve 147 forward against the biasing spring 148 by the leg engagement ends 173*e*. As a result, the slide sleeve 147 is moved forward away from the large bevel gear 135, and the clutch teeth 147*a* of the slide sleeve 147 are disengaged from the clutch teeth 135*a* of the large bevel gear 135. Thus, the slide sleeve 147 is switched to the power transmission interrupted state. On the other hand, when the mode switching member 155 is tuned to the hammer drill mode position or the drill mode position, as shown in FIGS. 3 and 9 or FIGS. 4 and 10, the frame member 173 is moved rearward (rightward as viewed in the drawings) by the second eccentric pin 175, and the engagement ends 173*e* on the leg ends are disengaged from the stepped portion 147*c* of the slide sleeve 147. Then the slide sleeve 147 is moved rearward toward the large bevel gear 135 by the biasing force of the biasing spring 148, and the clutch teeth 147*a* of the slide sleeve 147 engage with the clutch teeth 135*a* of the large bevel gear 135. Thus, the slide sleeve 147 is switched to the power transmission state.

Further, when the mode switching member 155 is turned to the hammer mode position, the instant when the slide sleeve 147 is placed in the power transmission interrupted state, the rotation locking teeth 147*b* of the slide sleeve 147 engage with the teeth 149*a* of the lock ring 149 and thus the slide sleeve 147 is locked against movement in the circumferential direction ("variolock" is effected).

Operation and usage of the hammer drill 101 constructed as described above will now be explained. When the user turns the mode-switching member 155 from the hammer drill mode position or the drill mode position to the hammer mode position shown in FIG. 5, in the first switching mechanism 157, the rotating member 166 is caused to rotate via the rotation transmitting shaft 163 and the third and fourth gears 164, 165. At this time, as shown in FIG. 2, the first eccentric pin 167 is caused to revolve downward about 120° on the axis of rotation of the rotating member 166 from its position in the hammer drill mode or the drill mode and is thus disengaged from the flange 124*b* of the clutch member 124. As a result, the clutch member 124 is moved downward toward the driven gear 123 by the biasing spring 126, and the clutch teeth 124*a* of the clutch member 124 engage with the clutch teeth 123*a* of the driven gear 123. Thus, the clutch member 124 is switched to the power transmission state.

Meanwhile, in the second switching mechanism 159, the second eccentric pin 175 is caused to revolve about 120° on the axis of rotation of the first gear 161 from its position in the hammer drill mode or the drill mode and moves the frame member 173 forward (toward the hammer bit 115). At this time, as shown in FIGS. 2 and 8, the forward moving frame member 173 pushes the slide sleeve 147 forward by the engagement ends 173*e* of the legs 173*b*, and thus the clutch teeth 147*a* of the slide sleeve 147 are disengaged from the clutch teeth 135*a* of the large bevel gear 135. Thus, the slide sleeve 147 is switched to the power transmission interrupted state. Further, the rotation locking teeth 147*b* of the slide sleeve 147 engage with the teeth 149*a* of the lock ring 149 and thus the slide sleeve 147 is locked against movement in the circumferential direction ("variolock").

In order to drive the hammer bit 119 in the hammer mode, the hammer bit 119 is adjusted (positioned) to a predetermined orientation in the circumferential direction. This adjustment can be made in the state in which the mode switching member 155 is turned to an intermediate position (neural position), which is not shown, between the hammer mode position and the hammer drill mode position, or between the hammer mode position and the drill mode position. Specifically, in this intermediate position, the clutch teeth 147*a* of the slide sleeve 147 are disengaged from the clutch teeth 135*a* of the large bevel gear 135, and the rotation locking teeth 147*b* of the slide sleeve 147 are disengaged from the teeth 149*a* of the lock ring 149. In this neutral state, the hammer bit 119 is adjusted in orientation. Thereafter, when the mode switching member 155 is turned to the hammer mode position, the above-mentioned "variolock" can be effected and the hammeing operation can be performed with the hammer bit 119 held in fixed orientation.

In this state in which the mode switching member 155 is in the hammer mode position, when the trigger 109*a* is depressed to drive the driving motor 111, the rotation of the driving motor 111 is converted into linear motion by the crank mechanism 114. The piston 129 then linearly slides along the cylinder 141. The striker 143 is caused to reciprocate within the cylinder 141 via the action of an air spring or pressure fluctuation of air within the air chamber 141*a* of the cylinder 141 which is caused by sliding movement of the piston 129. The striker 143 then collides with the impact bolt 145 and transmits the kinetic energy to the hammer bit 119. At this time, the slide sleeve 147 of the power transmitting mechanism 117 is in the power transmission interrupted state. Therefore, the hammer bit 119 does not rotate. Thus, in the hammer mode, a predetermined hammering operation can be performed solely by the striking movement (hammering movement) of the hammer bit 119.

Next, when the user turns the mode switching member 155 from the hammer mode position to the hammer drill mode position shown in FIG. 6, as shown in FIG. 3, the first eccentric pin 167 of the first switching mechanism 157 is caused to revolve about 120° on the axis of rotation of the rotating member 166 from its position in the hammer mode and comes close to the flange 124*b* of the clutch member 124. The first eccentric pin 167 only comes into contact with or faces the flange 124*b* with a slight clearance therebetween, and falls short of pushing up the flange 124*b*. Therefore, the clutch member 124 is held in the power transmission state. Meanwhile, the second eccentric pin 175 of the second switching mechanism 159 is caused to revolve about 120° on the axis of rotation of the first gear 161 from its position in the hammer mode and moves the frame member 173 rearward as shown in FIG. 9. Thus, the engagement ends 173*e* of the frame member 173 are disengaged from the slide sleeve 147, and then the slide sleeve 147 is moved toward the large bevel gear 135 by the biasing force of the biasing spring 148. As a result, the clutch teeth 147*a* engage with the clutch teeth 135*a* of large bevel gear 135. Thus, the slide sleeve 147 is switched to the power transmission state.

In this state, when the trigger 109*a* of the handgrip 109 is depressed to drive the driving motor 111, like in the hammer mode, the crank mechanism 114 is driven, and kinetic energy is transmitted to the hammer bit 119 via the striker 143 and the impact bolt 145 which form the striking mechanism 115. Meanwhile, the rotating output of the driving motor 111 is transmitted as rotation to the cylinder 141 via the power transmitting mechanism 117 and further transmitted as rotation to the tool holder connected to the cylinder 141 and to the hammer bit 119 held by the tool holder in such a manner as to be locked against relative rotation. Specifically, in the hammer drill mode, the hammer bit 119 is driven in the combined movement of striking (hammering) and rotation (drilling), so that a predetermined hammer-drill operation can be performed on a workpiece.

Next when the mode switching member 155 is turned from the hammer drill mode position to the drill mode position shown in FIG. 7, as shown in FIG. 4, the first eccentric pin 167 of the first switching mechanism 157 is caused to revolve about 120° on the axis of rotation of the rotating member 166 from its position in the hammer drill mode to the uppermost position in the vertical direction and pushes up the flange 124*b* of the clutch member 124. In other words, the clutch member 124 is moved upward away from the driven gear 123, so that the clutch teeth 124*a* of the clutch member 124 are disengaged from the clutch teeth 123*a* of the driven gear 123. Thus, the clutch member 124 is switched to the power transmission interrupted state. Meanwhile, the second eccentric pin 175 of the second switching mechanism 159 is caused to revolve about 120° on the axis of rotation of the first gear 161 from its position in the hammer drill mode. At this time, as shown in FIG. 10, the second eccentric pin 175 moves through a circular arc region of the oblong hole 173*d* of the base 173*a* of the frame member 173, so that the longitudinal components of the revolving movement of the second eccentric pin 175 are not transmitted to the frame member 173. Therefore, the frame member 173 is held in the same position as in the hammer drill mode, and the slide sleeve 147 is held in the power transmission state.

In this state, when the trigger 109*a* of the handgrip 109 is depressed to drive the driving motor 111, because the clutch member 124 is held in the power transmission interrupted state, the crank mechanism 114 is not driven and the hammer bit 119 does not perform the striking movement. Meanwhile, in the power transmitting mechanism 117, the slide sleeve 147 is held in the power transmission state, so that the rotating output of the driving motor 111 is transmitted as rotation to the hammer bit 119. Specifically, in the drill mode, the hammer bit 119 is driven solely by rotation (drilling movement), so that a predetermined drill operation can be performed on a workpiece.

In the electric hammer drill 101 according to this embodiment, the mode switching member 155 is disposed externally on the upper surface of the gear housing 107 or on the upper surface of the body 103. With this construction, the mode switching member 155 can be easily operated with one hand, whether right or left, while holding the handgrip 109 with the other hand.

Further, the rotation transmitting shaft 163, third gear 164, the fourth gear 165 and the rotating member 166 for transmitting the switching operation of the mode switching member 155 to the rotating member 166 are disposed outside the crank chamber 151. Therefore, the capacity (volume) of the crank chamber 151 can be reduced by the capacity (volume) for housing these components. Thus, the lubricant filled in the crank chamber 151 can be readily supplied to the sliding parts of the crank mechanism 114 and the power transmitting mechanism 117 which are housed within the crank chamber 151, so that these mechanisms improve in lubricity. Further, by reduction of the capacity of the crank chamber 151, the required amount of lubricant to be filled in the crank chamber 151 can be reduced.

Further, with the construction in which switching of the clutch member 124 is effected by utilizing rotation of the rotating member 166, the opening 168 connecting the crank chamber 151 and the housing space 152 can be closed all the time by the rotating member 166. Thus, even in the construction in which the switching operation transmitting mechanism 169 is disposed outside the crank chamber 151, switching of the clutch member 124 can be efficiently effected while avoiding the lubricant from leaking out of the crank chamber 151.

Further, according to this embodiment, in the construction in which the mode switching member 155 and the clutch member 124 are disposed on the opposite sides of the crank mechanism 114 in the vertical direction, an efficient switching arrangement is realized by utilizing the vertically extending rotation transmitting shaft 163 and the rotating member 166 having the eccentric pin 167 and extending in the direction crossing the rotation transmitting shaft 163. Such switching arrangement allows the clutch member 124 to be switched between the power transmission state and the power transmission interrupted state, while avoiding interference with the crank mechanism 114. In this case, rotation transmitting shaft 163 and the rotating member 166 rotate in the installed position and are connected to each other by the bevel gears in the form of the third and fourth gears 164, 165, so that the rotation transmitting shaft 163 and the rotating member 166 can be installed in a smaller space.

Further, in this embodiment, the eccentric pin 167 disposed in a position displaced from the axis of rotation of the rotating member 166 is designed as an actuating member for switching the clutch member 124 between the power transmission state and the power transmission interrupted state. Thus, switching of the state of the clutch member 124 can be realized with a simple construction, which is effective in simplification in structure and cost reduction.

Second Representative Embodiment

A second representative embodiment of the present invention is explained with reference to FIGS. 11 to 14. This embodiment relates to a modification to the switching arrangement for switching the clutch member 124 of the crank mechanism 114 between the power transmission state and the power transmission interrupted state. Therefore, components which are substantially identical to those in the first embodiment are given like numerals as in the first embodiment and will not be described.

Figure 11:
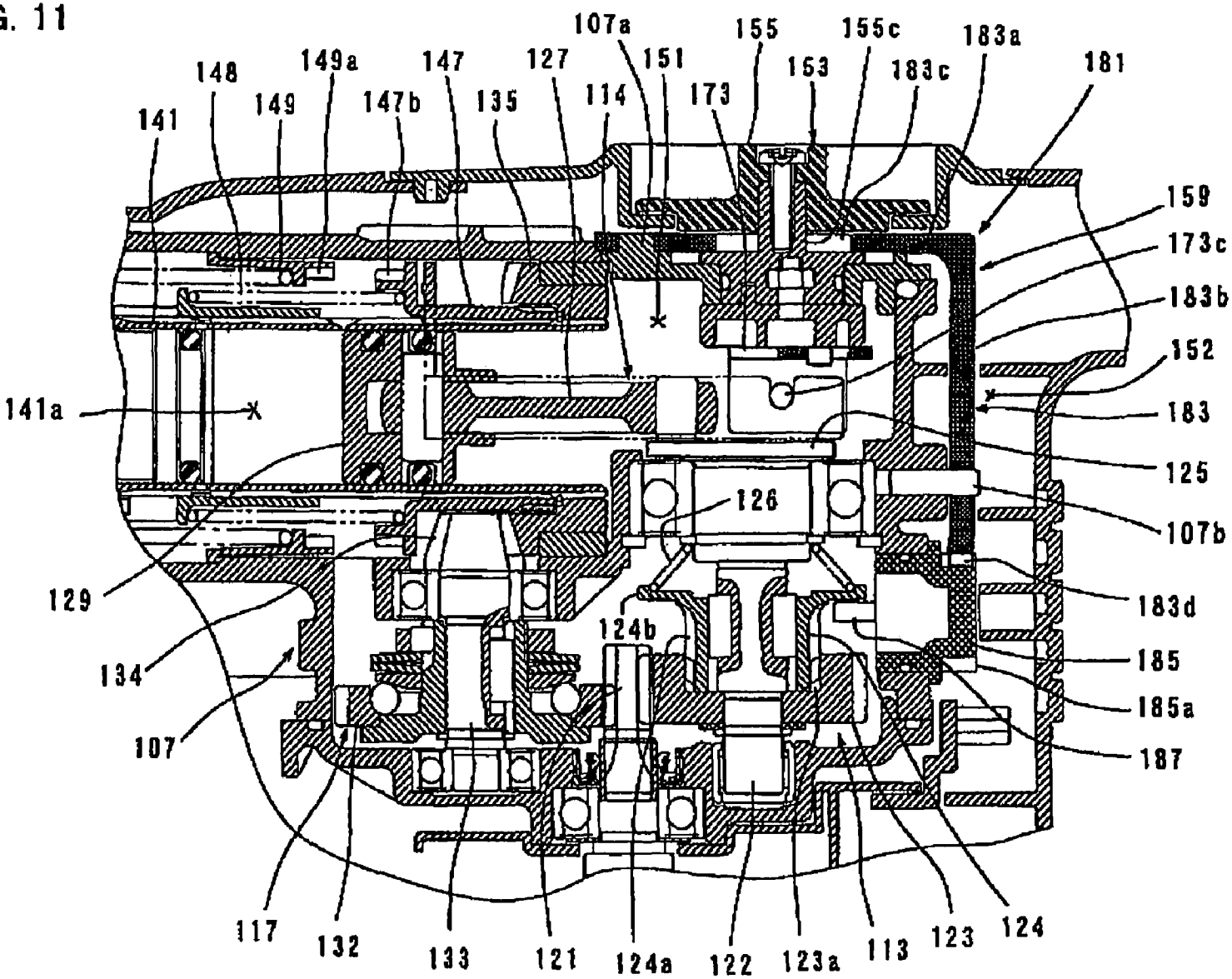
FIG. 11 is a sectional side view of an essential part of a hammer drill, in the hammer drill mode according to a second representative embodiment of the invention.
Figure 12:
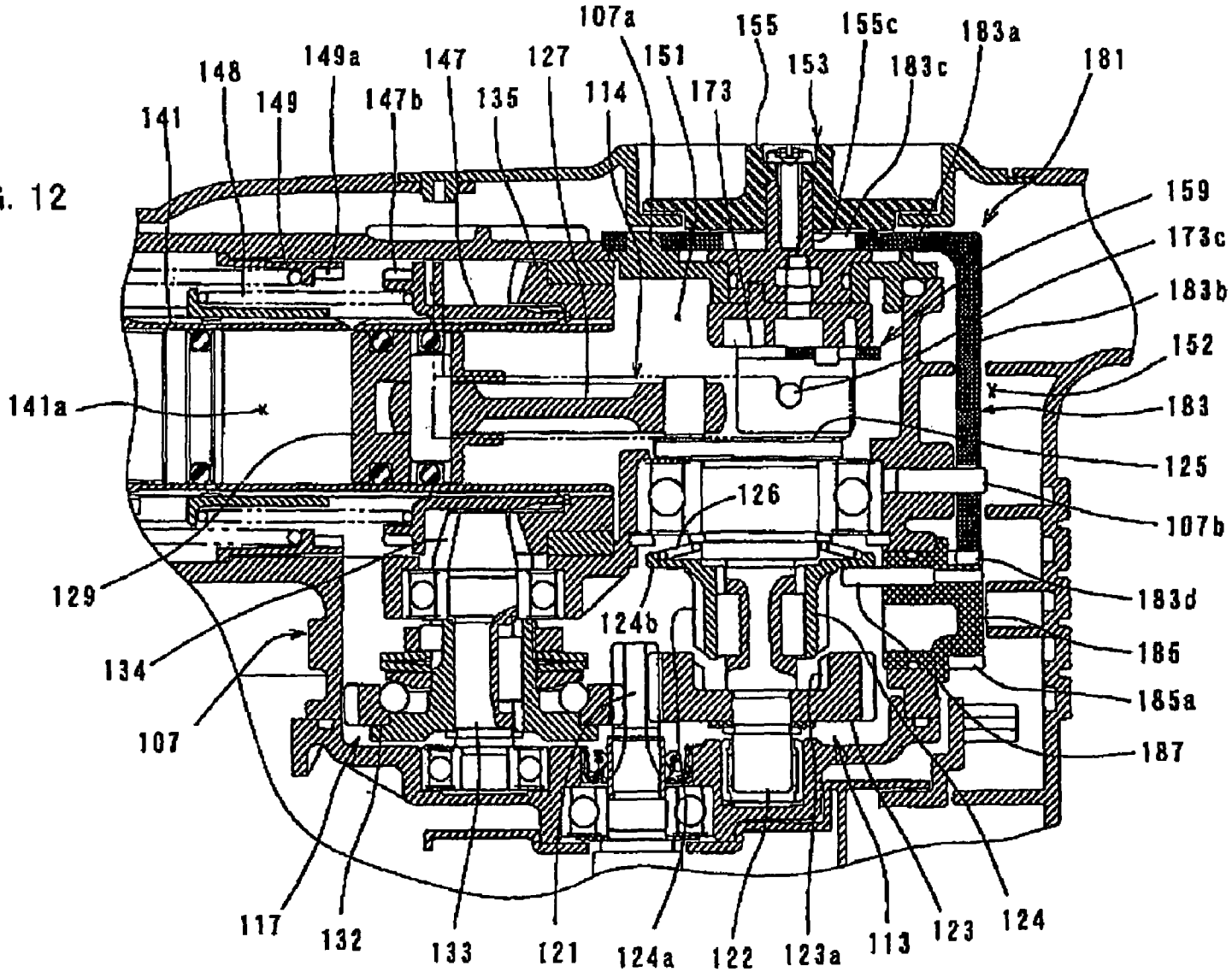
FIG. 12 is a sectional side view of the essential part of the hammer drill in the drill mode according to the second embodiment of the invention.
Figure 13:
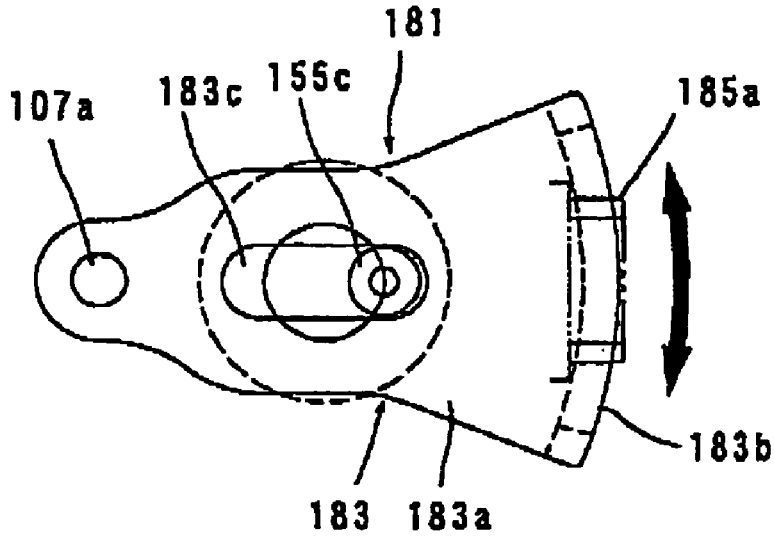
FIG. 13 is a plan view showing a swinging member.
Figure 14:
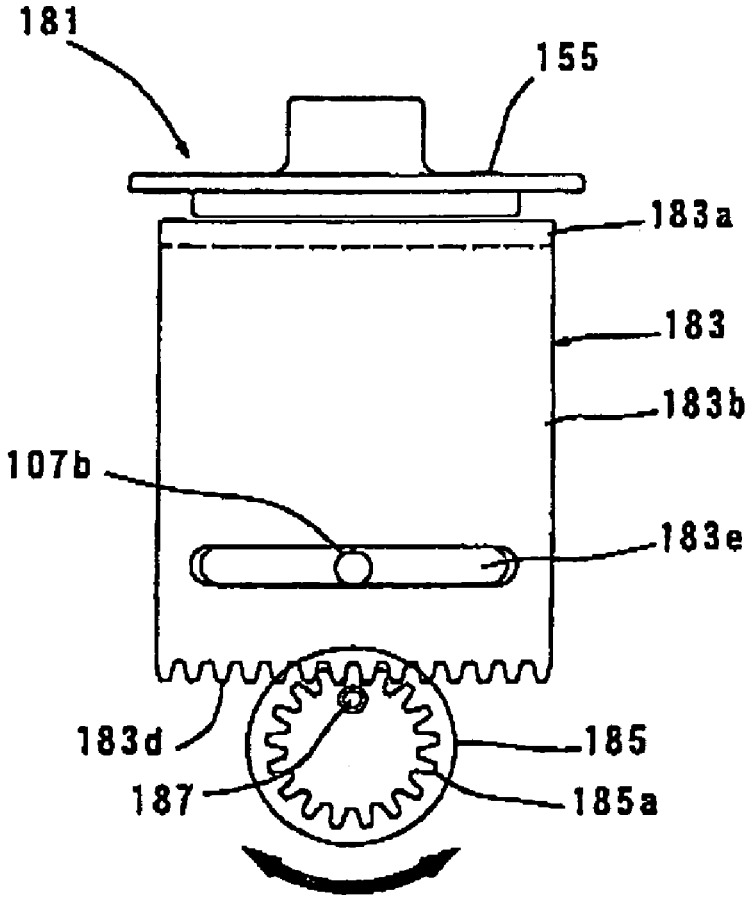
FIG. 14 is a side view showing the swinging member and a rotating member.
Figure 15:
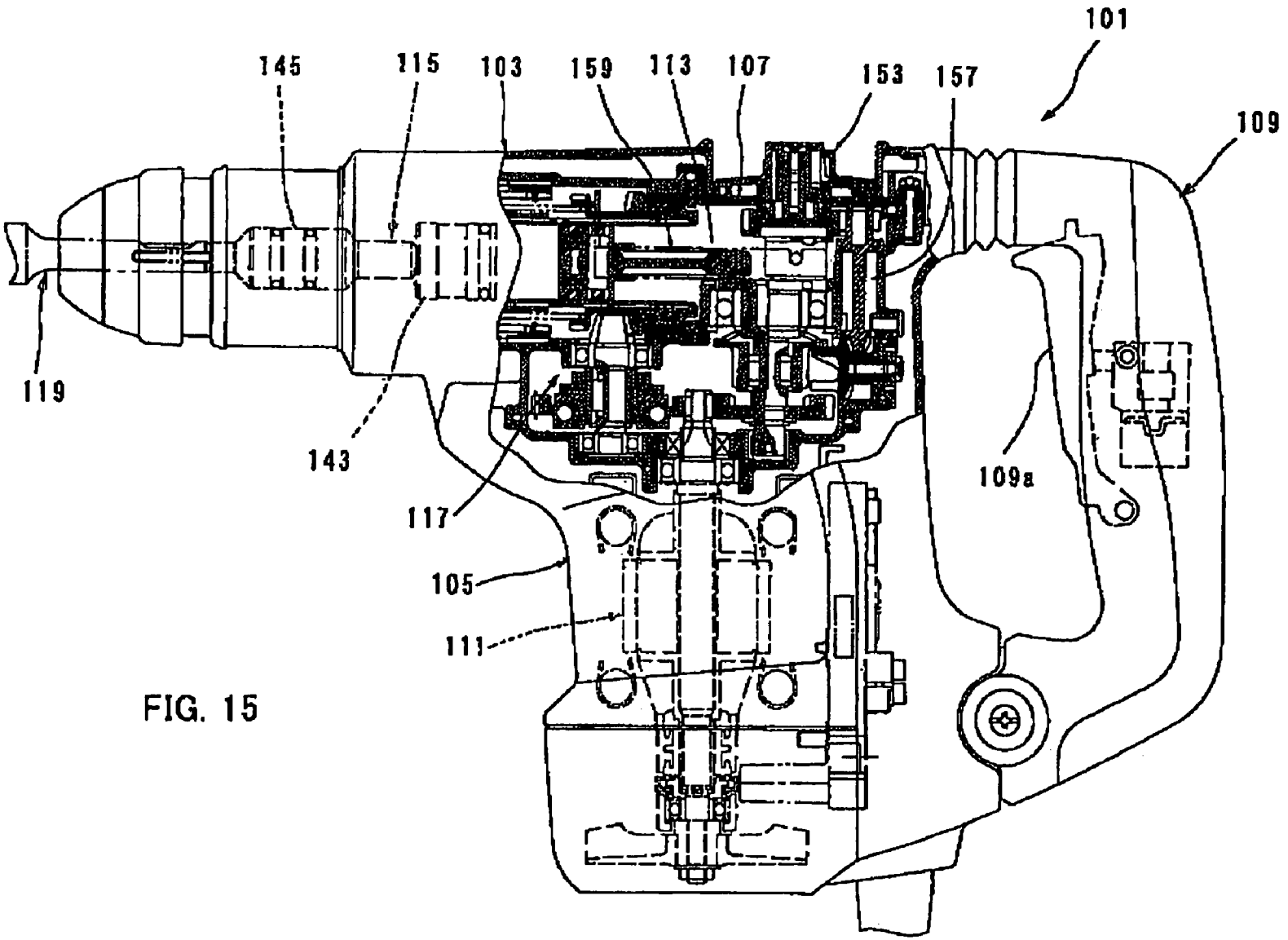
FIG. 15 is a sectional side view schematically showing an entire hammer drill according to a third representative embodiment of the invention.

FIGS. 11 and 12 are sectional views showing an essential part of the hammer drill 101 having a first switching mechanism 181 according to this embodiment. FIG. 13 is a plan view showing the first switching mechanism 181 and FIG. 14 is a side view of the first switching mechanism 181. The first switching mechanism 181 according to this embodiment mainly includes a swinging member 183 and a rotating member 185. The swinging member 183 forms a switching operation transmitting mechanism for transmitting the switching operation of the mode switching member 155 to the rotating member 185. The swinging member 183 includes a plate-like member having a generally L-shaped section including a horizontal plate portion 183*a* and a vertical plate portion 183*b*. The horizontal plate portion 183*a* is disposed under the mode switching member 155, and the front end portion (on the hammer bit side) of the horizontal plate portion 183*a* is connected to the gear housing 107 via a pin 107*a* formed on the gear housing 107 such that the horizontal plate portion 183*a* can swing on the pin 107*a* in a horizontal plane. Further, the horizontal plate portion 183*a* has a slot 183*c* extending in the longitudinal direction of the cylinder 141. An eccentric portion 155*c* of the mode switching member 155 is engaged with the slot 183*c*. Therefore, when the mode switching member 155 is turned, the swinging member 183 swings horizontally on the pin 107*a*. Further, the slot 183*c* may be formed in the mode switching member 155, and the eccentric portion 155*c* may be provided on the horizontal plate portion 183*a*.

The vertical plate portion 183*b* of the swinging member 183 is disposed outside the crank chamber 151 or in the housing space 152 of the gear housing 107. The vertical plate portion 183*b* has a circular arc shape having its center on the pin 107*a* and extends downward from a connection with the horizontal plate portion 183*a*. A gear 183*d* is formed in the lower end of the vertical plate portion 183*b* and extends in the swinging direction. The gear 183*d* is engaged with a circular gear 185*a* formed in the rotating member 185. The rotating member 185 has a first eccentric pin 187. The first eccentric pin 187 extends into the crank chamber 151 through an opening 188 and can engage with the underside of the flange 124*b* of the clutch member 124, like in the first embodiment. Further, the vertical plate portion 183*b* has a guide groove 183*e* extending in the swinging direction, and the guide groove 183*e* engages with a guide pin 107*b* extending horizontally from the gear housing 107. Therefore, the swinging member 183 swings while being guided by the guide pin 107*b*, so that the swinging movement is stabilized.

The first switching mechanism 181 according to this embodiment is thus constructed. Therefore, when the mode switching member 155 is turned for a mode change, the swinging member 183 is caused to swing clockwise or counterclockwise on the pin 107*a* by the eccentric portion 155*c* of the mode switching member 155. Then the rotating member 185 is caused to rotate via the gears 183*d*, 185*a*. When the rotating member 185 rotates, the first eccentric pin 187 revolves on the axis of rotation of the rotating member 185 and thus, the vertical position of the first eccentric pin 187 changes. As a result, the clutch member 124 is moved in the longitudinal direction of the crank shaft 122 and thus switched to the power transmission state or the power transmission interrupted state, like in the first embodiment. FIG. 12 shows the state in which the mode switching member 155 is turned to the hammer drill mode position and the clutch member 124 is switched to the power transmission state. FIG. 13 shows the state in which the mode switching member 155 is turned to the drill mode position and the clutch member 124 is switched to the power transmission interrupted state.

According to this embodiment, the rotating member 185 having the first eccentric pin 187 for switching the operating state of the clutch member 124 and the swinging member 183 for transmitting the switching operation of the mode switching member 155 to the rotating member 185 are disposed outside the crank chamber 151. Therefore, like in the first embodiment, the capacity of the crank chamber 151 can be reduced while avoiding the lubricant from leaking out of the crank chamber 151, so that the effect of the lubricant lubricating the crank mechanism 114 or the power transmitting mechanism 117 can be enhanced.

Further, with the construction in which the rotating member 185 is caused to rotate by utilizing the swinging movement of the swinging member 183, the swinging member 183 can be reduced in thickness in the longitudinal direction crossing the direction of the swinging movement. Therefore, the housing space 152 within the gear housing 107 can be reduced in the longitudinal direction, so that the body 103 can be reduced in size in the longitudinal direction.

Third Representative Embodiment

A third representative embodiment of the present invention is explained with reference to FIGS. 15 to 20. This embodiment relates to a mounting structure mounting operation of the first switching mechanism 157 according to the above-described mode switching mechanism 153. Therefore, components which are substantially identical to those in the first embodiment are given like numerals as in the first embodiment and will not be described.

Figure 17:
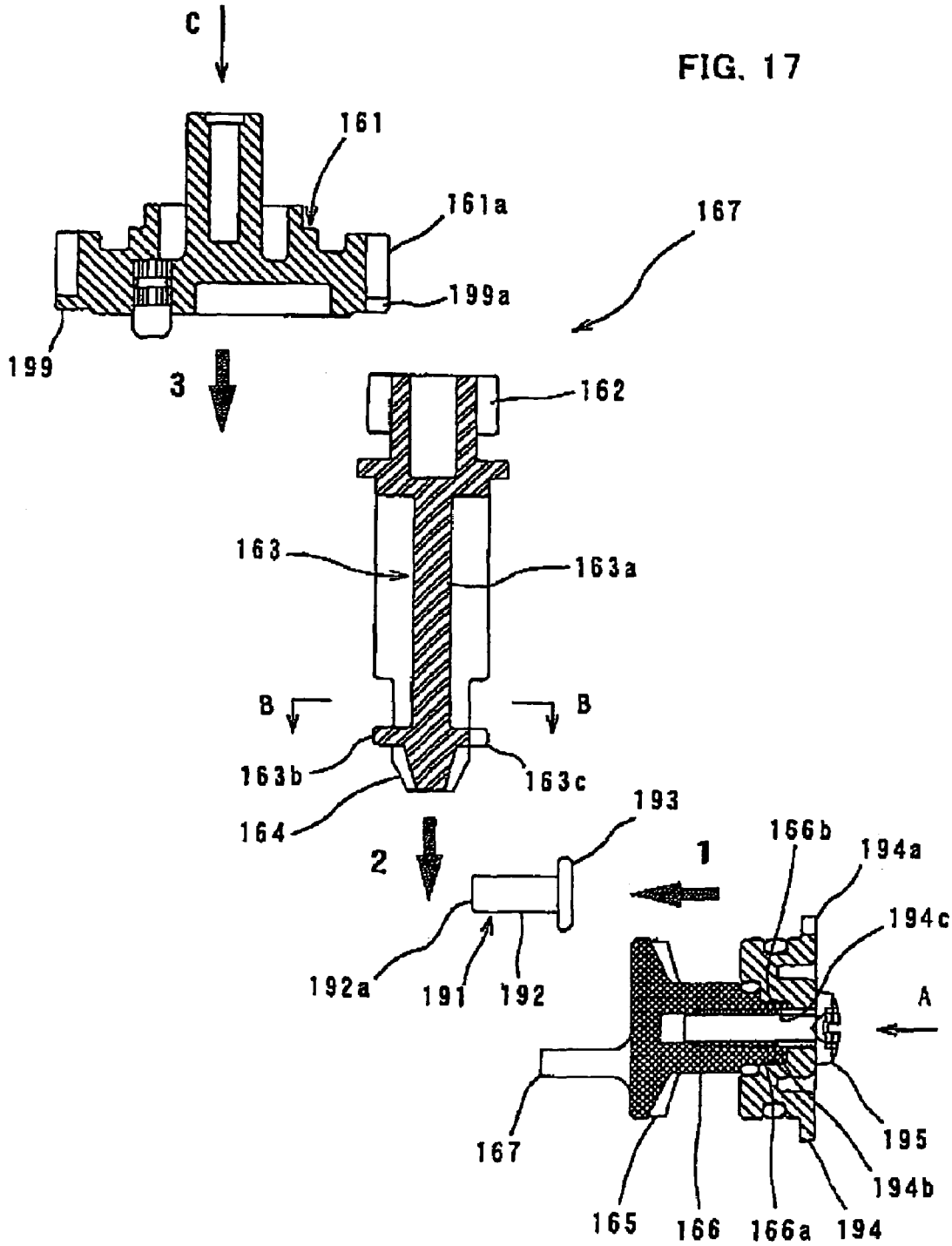
FIG. 17 illustrates the construction and method for mounting a first switching mechanism in a gear housing.
Figure 18:
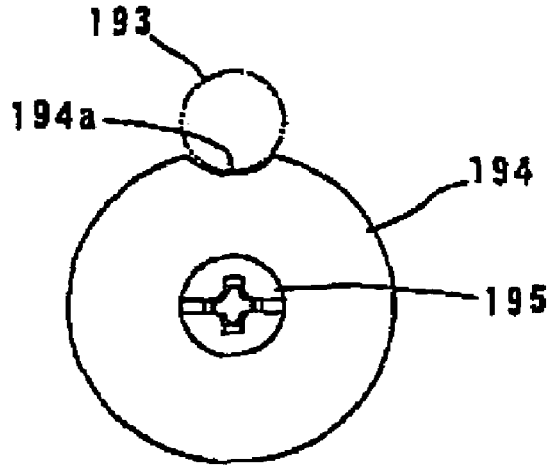
FIG. 18 is an illustration as viewed from the direction of arrow A in FIG. 17.
Figure 19:
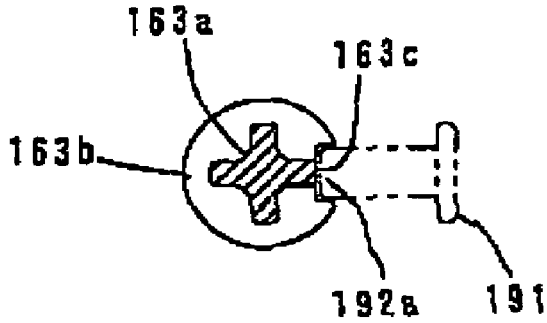
FIG. 19 is a sectional view taken along line B-B in FIG. 17.
Figure 20:
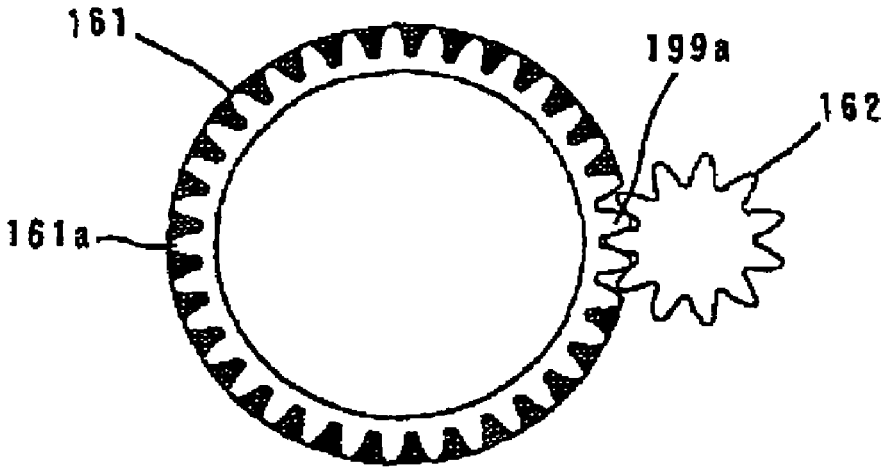
FIG. 20 is an illustration as viewed from the direction of arrow C in FIG. 17.
Figure 21:
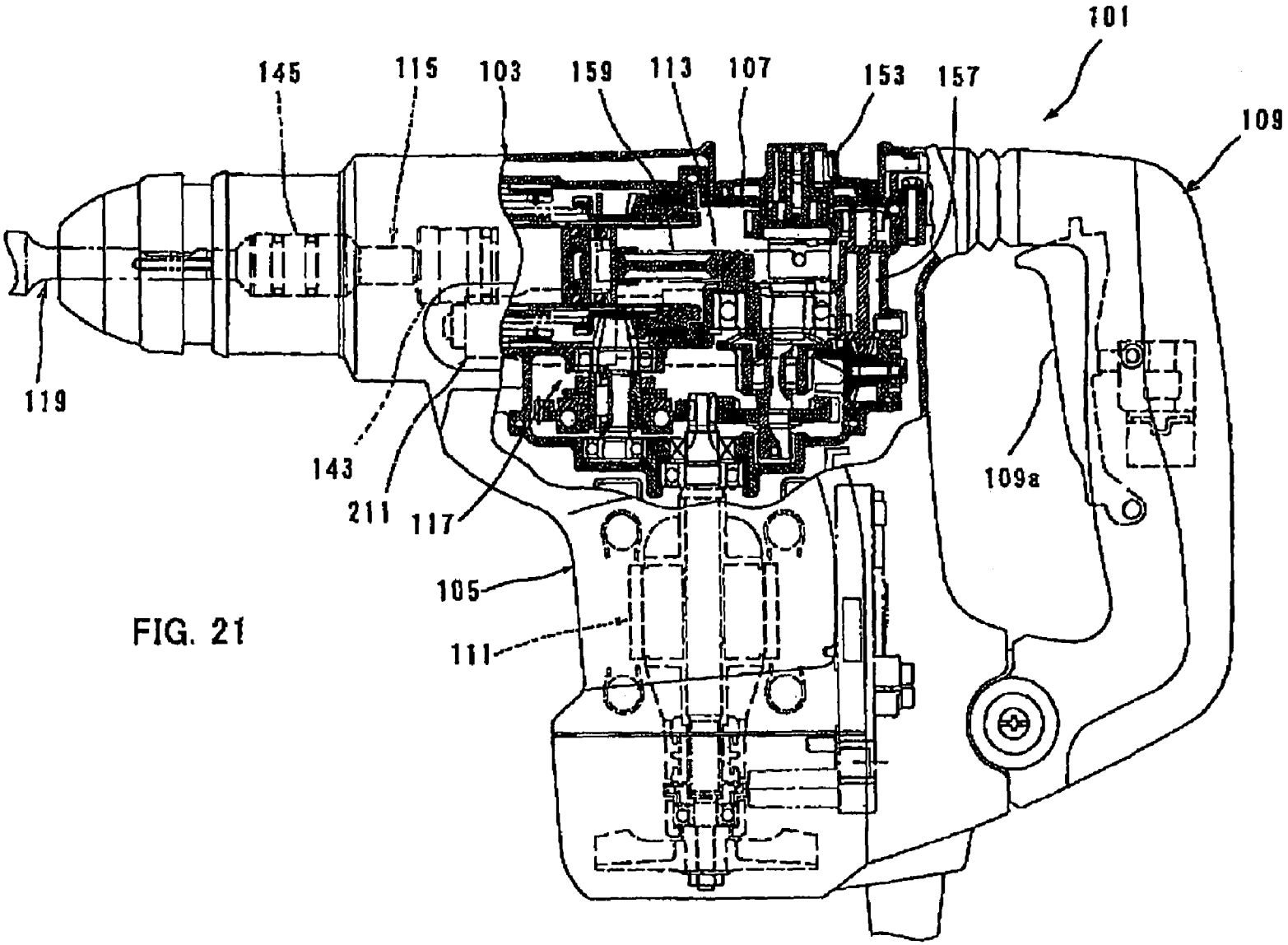
FIG. 21 is a sectional side view schematically showing an entire hammer drill according to a fourth embodiment of the invention.
Figure 22:
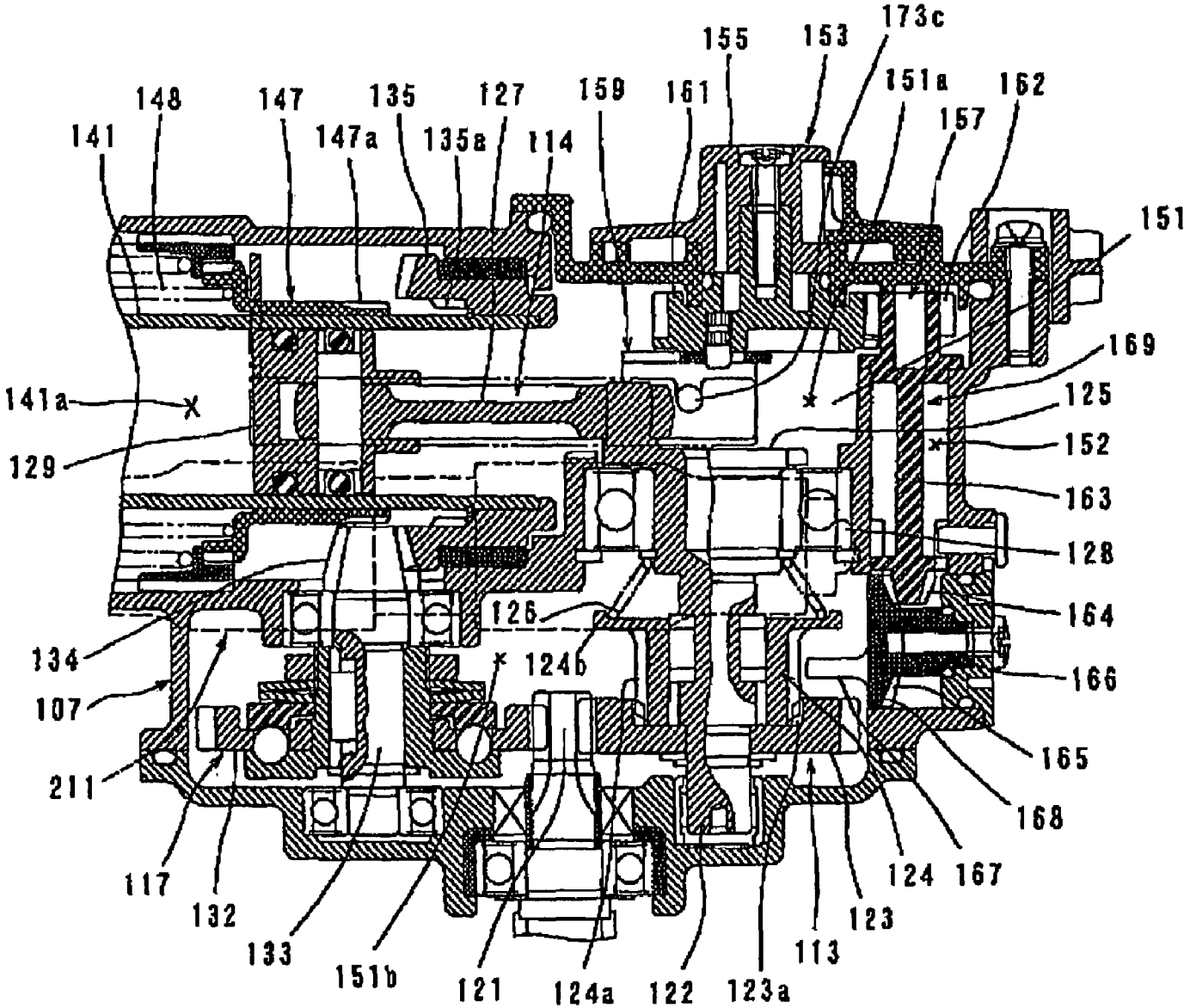
FIG. 22 is a sectional side view of an essential part of the hammer drill in hammer mode.
Figure 23:
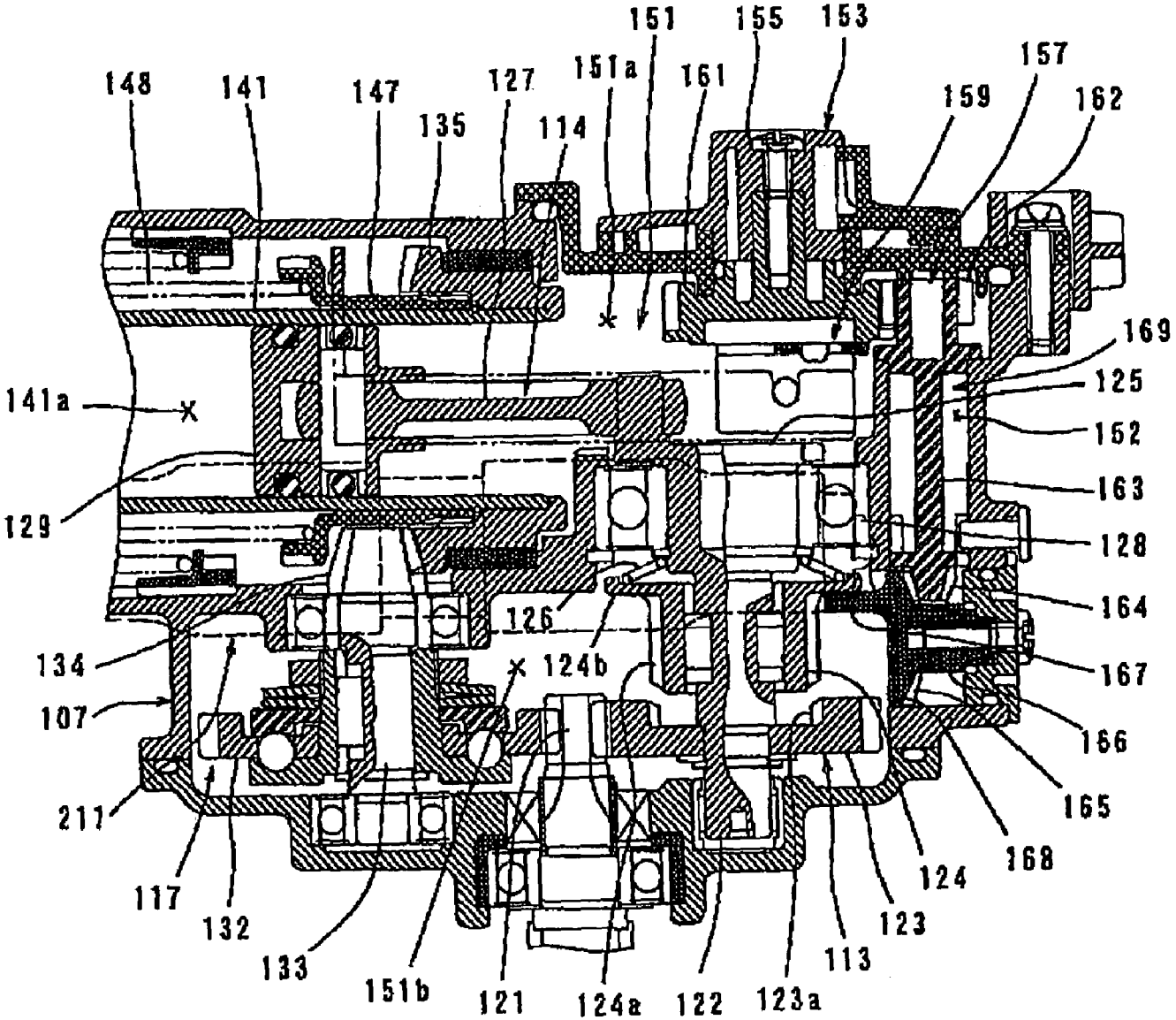
FIG. 23 is a sectional side view of an essential part of the hammer drill in drill mode.
Figure 24:
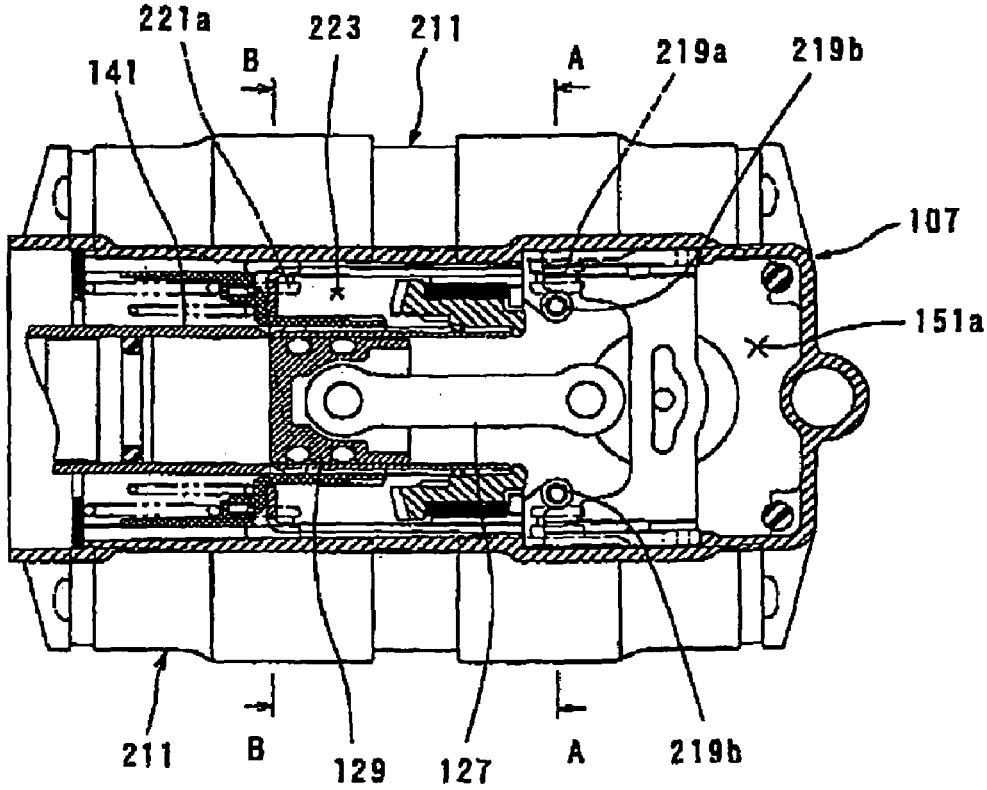
FIG. 24 is a plan view showing the configuration of a dynamic vibration reducer.

FIG. 17 illustrates the construction and method for mounting the first switching mechanism 157 in the gear housing 107. FIG. 18 is an illustration as viewed from the direction of arrow A in FIG. 17. FIG. 19 is a sectional view taken along line B-B in FIG. 17. FIG. 20 is an illustration as viewed from the direction of arrow C in FIG. 17.

As mentioned above, the first switching mechanism 157 includes the first gear 161 integrally formed with the mode switching member 155, the second gear 162 that engages with the first gear 161, the rotation transmitting shaft 163 having the second gear 162 as an integral part, the third gear 164 integrally formed with the rotation transmitting shaft 163, the fourth gear 165 that engages with the third gear 164, the rotating member 166 having the fourth gear 165 as an integral part, and the first eccentric pin 167 integrally formed with the rotating member 166. In this construction, the positional relationship between the switching position to which the mode switching member 155 is turned and the operating position to which the first eccentric pin 167 is moved when the mode switching member 155 is turned for mode change is extremely important. In other words, if the positional relationship is not proper, the first eccentric pin 167 fails to move the clutch member 124 by a predetermined amount, which may cause a malfunction. In order to avoid such malfunction, when the above-mentioned members forming the first switching mechanism 157 are mounted in the gear housing 107, the engagement between the first and second gears 161 and 162 and the engagement between the third and fourth gears 164 and 165 must be made in respective predetermined proper positional relationships with respect to each other in the respective circumferential directions (in the respective directions of rotation).

The members forming the first switching mechanism 157 are mounted in the gear housing 107 by inserting the rotating member 166 having the first eccentric pin 167 and the fourth gear 165, the rotation transmitting shaft 163 having the third gear 164 and the second gear 162, and the mode switching member 155 having the first gear 161, in this order, into associated mounting holes 107*c*, 107*d*, 107*e* (see FIG. 16) of the gear housing 107. The inserting order and direction are shown by numerals and arrows in FIG. 17. In his insertion mounting process of the first switching mechanism 157, the fourth gear 165 of the rotating member 166 and the third gear 164 of the rotation transmitting shaft 163 and further the second gear 162 of the rotation transmitting shaft 163 and the first gear 161 of the mode switching member 155 are engaged with each other in respective proper positional relationships with respect to each other in the respective circumferential directions (in the respective directions of rotation). To this end, a positioning member is provided for each engagement in order to define the circumferential positions of the components when inserted.

A positioning member for the fourth gear 165 of the rotating member 166 and the third gear 164 of the rotation transmitting shaft 163 comprises a positioning pin 191 mounted in the gear housing 107. The third gear 164, the fourth gear 165 and the positioning pin 191 are features that correspond to the "driving-side rotating member", the "driven-side rotating member" and the "positioning member", respectively, according to this invention. The positioning pin 191 includes a shank 192 and a flange 193 and is mounted in the gear housing 107 such that its axial direction is parallel to the axial direction (longitudinal direction) of the rotating member 166. The positioning pin 191 mounted in the gear housing 107 is designed such that the flange 193 is exposed to the outside of the gear housing 107 and the end of the shank 192 protrudes a predetermined length into the gear housing 107.

The rotating member 166 includes a disc 194 that is fastened by a screw 195 to an axial end of the rotating member on the side opposite to the fourth gear 165. The rotating member 166 is a feature that corresponds to the "driven shaft" according to this invention. The disc 194 has a diameter slightly larger than the outside diameter of the fourth gear 165. A recess 194*a* (see FIG. 18) is formed in the periphery of the disc 194 and has a circular shape complementary to the circular shape of the outer edge of the flange 193. A circular mounting hole 107*c* (see FIG. 16) for mounting the rotating member 166 is formed though the gear housing 107 in the longitudinal direction (in the direction crossing the longitudinal direction of the crank shaft 122). The rotating member 166 is inserted into the mounting hole 107*c* from behind in order to be mounted in the gear housing 107. In this insertion mounting, the disc 194 of the rotating member 166 is allowed to pass the flange 193 without interference with the flange 193 when the recess 194*a* of the disc 194 is aligned with the peripheral edge of the flange 193 of the positioning pin 191, or when the circular surface of the recess 194*a* is placed in a position (see FIGS. 17 and 18) corresponding to the peripheral edge of the flange 193. On the other hand, when the recess 194*a* of the disc 194 is not in alignment with the peripheral edge of the flange 193, the disc 194 interferes with the flange 193 and is thus prevented from being further inserted into the mounting hole 107*c*. In other words, the rotating member 166 having the fourth gear 165 is allowed to be mounted in the gear housing 107 only when inserted into the mounting hole 107*c* with proper positioning in a predetermined relative position in the circumferential direction with respect to the positioning pin 191. Further, the rotating member 166 inserted into the gear housing 107 until the disc 194 passes the flange 193 of the positioning pin 191 and is rotatably supported in the position by the inner wall surface of the mounting hole 107*c*. In this state, the first eccentric pin 167 faces the flange 124*b* of the clutch member 124.

Figure 16:
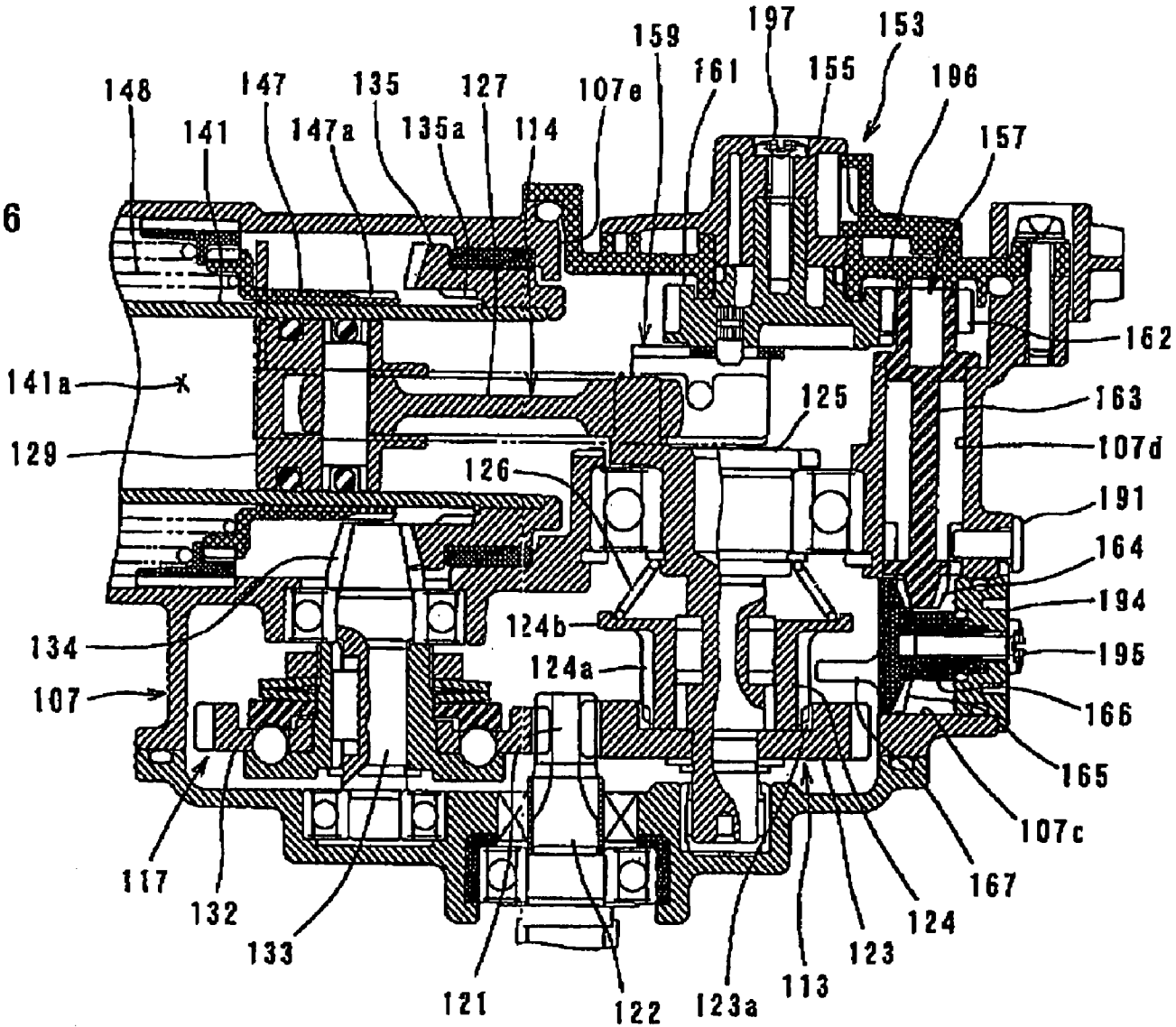
FIG. 16 is a sectional side view of an essential part of the hammer drill.

As shown in FIGS. 16 and 17, a shank 166*a* formed in one axial end of the rotating member 166 and a shank hole 194*b* formed in the disc 194 are fitted together, and in this state, the rotating member 166 and the disc 194 are fastened together by a screw 195. The shank 166*a* and the shank hole 194*b* have circular sections having notched planar surfaces 166*b*, 194*c*, respectively, in a part in the circumferential direction and are fitted together in the state fixed in position via the respective planar surfaces 166*b*, 194*c*. In other words, the rotating member 166 and the disc 194 can be fastened together by the screw 195 only when the shank 166*a* and the shank hole 194*b* are placed in a predetermined relative position. Thus, in the state fastened by the screw 195, the first eccentric pin 167 of the rotating member 166 and the positioning recess 194*a* of the disc 194 are held in a predetermined positional relationship.

The rotation transmitting shaft 163 has a flange 163*b* formed between a shank 163*a* and the third gear 164 and having a diameter larger than the diameter of the third gear 164. A generally rectangular recess 163*c* (see FIG. 19) is formed in the periphery of the flange 163*b* and has a width corresponding to the outside diameter of a shank end portion 192*a* of the positioning pin 191. The rotation transmitting shaft 163 is a feature that corresponds to the "driving shaft" according to this invention. A circular mounting hole 107*d* (see FIG. 16) for mounting the rotation transmitting shaft 163 is formed through the gear housing 107 in the vertical direction (in the longitudinal direction of the crank shaft 122). The rotation transmitting shaft 163 is inserted into the vertical mounting hole 107*d* from above in order to be mounted in the gear housing 107. In this insertion mounting, the flange 163*b* of the rotation transmitting shaft 163 is allowed to pass the shank end portion 192*a* without interference with the shank end portion 192*a* when the recess 163*c* of the flange 163*b* is aligned with the shank end portion 192*a* of the positioning pin 191, or when the recess 163*c* is placed in a position (see FIGS. 17 and 19) corresponding to the shank end portion 192*a* in the circumferential direction. On the other hand, when the recess 163*c* of the flange 163*b* is not in alignment with the shank end portion 192*a*, the flange 163*b* interferes with the shank end portion 192*a* and is thus prevented from being further inserted into the mounting hole 107*d*. In other words, the rotation transmitting shaft 163 having the third gear 164 is allowed to be mounted in the gear housing 107 only when inserted into the mounting hole 107*d* with proper positioning in a predetermined relative position in the circumferential direction with respect to the positioning pin 191. Further, the rotation transmitting shaft 163 is inserted into the gear housing 107 until the flange 163*b* passes the shank end portion 192*a* of the positioning pin 191 and is rotatably supported in the position by the inner wall surface of the mounting hole 107*d*.

As mentioned above, the rotating member 166 and the rotation transmitting shaft 163 are mounted in the gear housing 107 such that the respective longitudinal directions cross each other. In the state in which the rotating member 166 and the rotation transmitting shaft 163 are mounted in the gear housing 107, the fourth gear (bevel gear) 165 of the rotating member 166 and the third gear (bevel gear) 164 of the rotation transmitting shaft 163 are engaged with each other in a predetermined proper positional relationship.

A positioning member for the second gear 162 of the rotation transmitting shaft 163 and the first gear 161 of he mode switching member 155 will now be explained. As shown in FIG. 16, the mode switching member 155, the first gear 161 and a cover 196 are connected together by a screw 197 and form a mode switching assembly. The mode switching assembly is inserted from above into a mounting hole 107*e* formed in the upper surface of the gear housing 107 in order to be mounted in the gear housing 107. Specifically, in this mounting, the mode switching assembly is inserted into the mounting hole 107*e* while sliding in the direction of the gear thickness (in the long direction) with the teeth of the first gear 161 and the teeth of the second gear 162 engaged with each other.

As shown in FIG. 17, the positioning member for the second gear 162 and the first gear 161 comprises a positioning wall 199 formed in the first gear 161. The positioning wall 199 is formed on the lower end surface of the first gear 161 in the axial direction in such a manner as to cover one end of a teeth section 161*a* in the direction of the tooth thickness. Specifically, the positioning wall 199 has about the same outside diameter as the gear diameter of the first gear 161 and has an opening 199*a* in a predetermined region in the circumferential direction of the positioning wall 199. In mounting the mode switching assembly in the gear housing 107, the positioning wall 199 is allowed to pass a teeth section 162*a* of the second gear 162 without interference with the teeth section 162*a* when the opening 199*a* is placed in a position (see FIGS. 17 and 19) corresponding to (in alignment with) the teeth section 162*a* of the second gear 162. On the other hand, when the opening 199*a* is not in alignment with the teeth section 162*a* of the second gear 162, the positioning wall 199 interferes with the teeth section 162*a* of the second gear 162 and is thus prevented from being inserted into the mounting hole 107*e*. In other words, the mode switching member 155 having the first gear 161 is allowed to be mounted in the gear housing 107 only when the first gear 161 is property positioned in a predetermined relative position in the circumferential direction with respect to the second gear 162. As a result, the first gear 161 and the second gear 162 are engaged with each other in a predetermined proper positional relationship. Thus, according to this embodiment, the mode switching member 155 and the first eccentric pin 167 are inevitably assembled in a predetermined positional relationship.

As mentioned above, according to this embodiment, the rotation transmitting shaft 163 having the third gear 164 and the rotating member 166 having the fourth gear 165 can be mounted in the gear housing 107 only when inserted in a predetermined relative position defined by the positioning pin 191. Further, the mode switching member 155 having the first gear 161 can be mounted in the gear housing 107 only when positioned in a predetermined relative position defined by the positioning wall 199. As a result, the third and fourth gears 164 and 165 and the first and second gears 161 and 162 can be reliably engaged with each other in respective predetermined paper positional relationships or can be reliably prevented from being engaged with each other in improper positional relationship.

Further, according to this embodiment, the third gear 164 and the fourth gear 165 can be positioned by using the axial end portion of the shank 192 and the peripheral edge portion of the flange 193 of the positioning pin 191, so that the third gear 164 and the fourth gear 165 arranged crisscross with respect to each other can be efficiently engaged in a predetermined relative position by using the single positioning pin 191.

Further, in this embodiment for the purpose of positioning the positioning pin 191 and the fourth gear 165, the positioning recess 194*a* is formed in the disc 194 of the rotating member 166. However, such a positioning recess may be formed in the positioning pin 191. Further, in this embodiment, for the purpose of positioning the third gear 164 with respect to the positioning pin 191, the positioning recess 163*c* is formed in the flange 163*b* of the rotation transmitting shaft 163. Such a positioning recess may be formed in the positioning pin 191.

Further, the driving-side rotating member or the driven-side rotating member may be constructed as follows according to the invention:

"One or both of the driving-side rotating member and the driven-side rotating member include a plurality of elements that can be engaged with each other, and the plurality of elements are allowed to be engaged with each other only when placed in a predetermined relative position and are prevented from being engaged with each other when placed in a position other than the predetermined relative position."

"The driven-side rotating member includes a plurality of elements that are fitted together in the direction of the driven shaft and in this state fastened together, and the plurality of elements are allowed to be fitted together only when placed in a predetermined relative position in the circumferential direction around the direction of the driven shaft, while being prevented from being fitted together when placed in a position other than the predetermined relative position."

In his construction, the "plurality of elements" may typically comprise the rotating member 166 and the disc 194. According to this embodiment, the plurality of elements can be properly fastened in a predetermined relative position.

Fourth Representative Embodiment

A fourth representative embodiment of the present invention is explained with reference to FIGS. 21 to 27. This embodiment relates to a technique to reduce vibration caused during an operation work by adding a dynamic vibration reducer to the power tool. Therefore, components which are substantially identical to those in the first embodiment are given like numerals as in the first, second and/or third embodiment and will not be described.

The motion converting mechanism 113 and the power transmitting mechanism 117 are housed within a hermetically closed driving section housing chamber 151 defined by the gear housing 107. Sliding parts are lubricated by lubricant (grease) filled in the driving section housing chamber 151. The driving section housing chamber 151 is partitioned into an upper chamber 151*a* and a lower chamber 151*b* by a bearing 128 (ball bearing) 128 that rotatably supports the crank shaft 122. The upper chamber 151*a* and the lower chamber 151*b* are features that correspond to the "crank chamber" and the "clutch chamber", respectively, according to this invention. The upper chamber 151*a* houses the crank mechanism 114 of the motion converting mechanism 113, and the lower chamber 151*b* houses the driving gear 121, the driven gear 123 and the clutch member 124, and most of the power transmitting mechanism 117. One end of the upper chamber 151*a* in a longitudinal direction of the cylinder 141 is open.

The upper chamber 151*a* and the lower chamber 151*b* defined by the bearing 128 are allowed to communicate with each other only through a clearance formed in the bearing 128. Therefore, when the crank mechanism 114 is driven and the cylinder 129 reciprocates within the cylinder bore, the capacity of the upper chamber 151*a* is increased or reduced, so that the pressure within the upper chamber 151*a* fluctuates. At this time, the lower chamber 151*b* is held unaffected or hardly affected by the pressure fluctuations of the upper chamber 151*a*.

Figure 25:
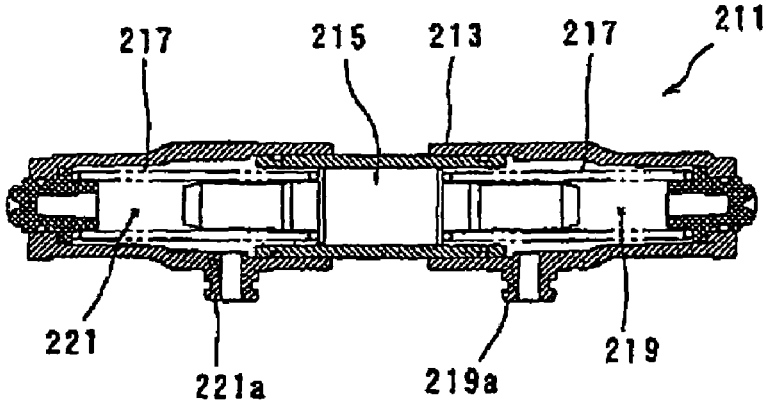
FIG. 25 is a sectional view showing the entire dynamic vibration reducer.
Figure 26:
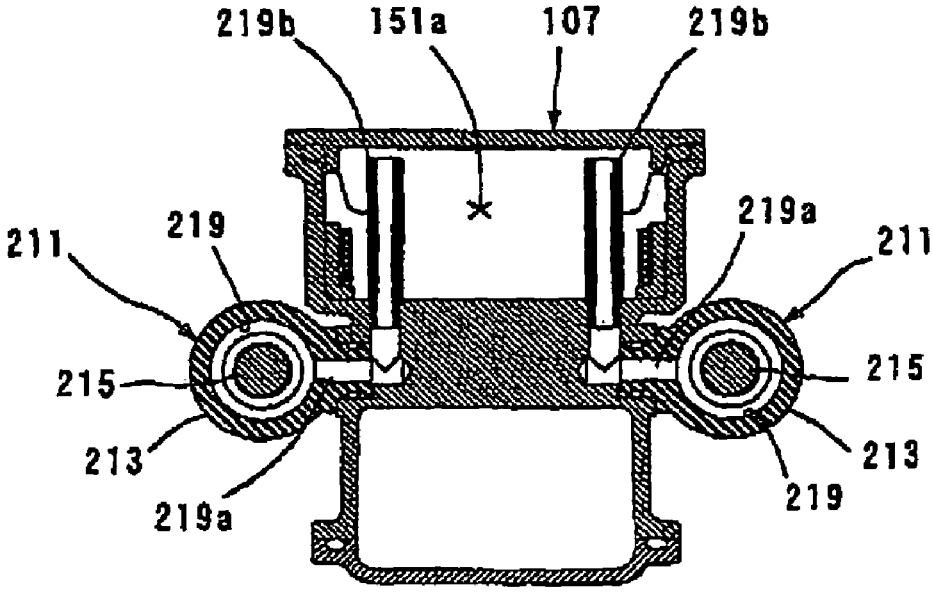
FIG. 26 is a sectional view taken along line A-A in FIG. 24.
Figure 27:
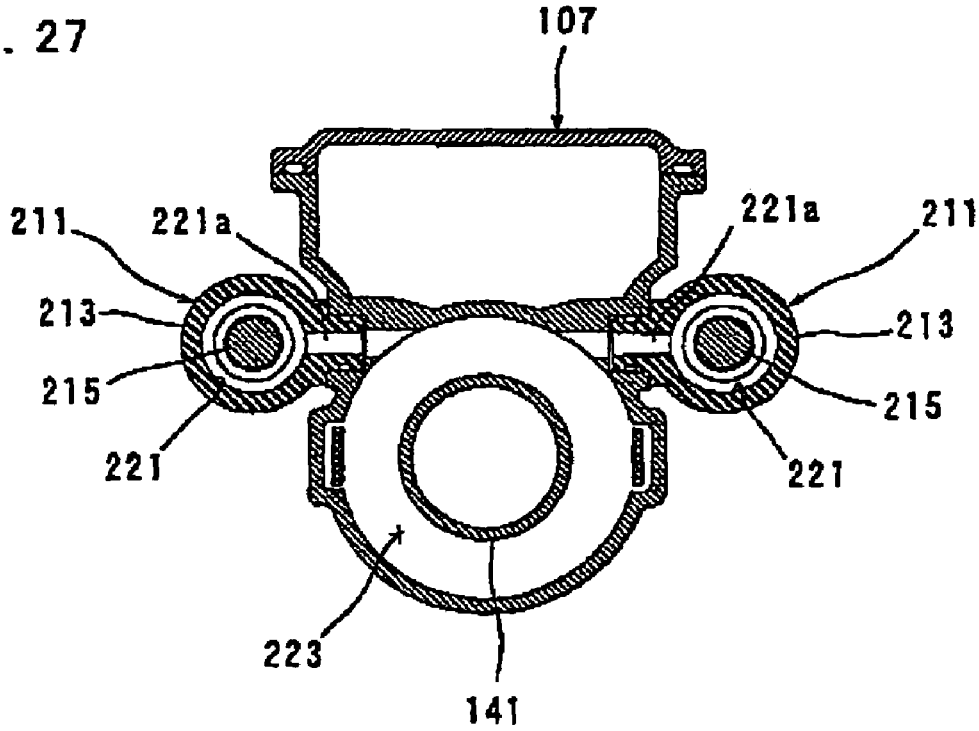
FIG. 27 is a sectional view taken along line B-B in FIG. 24.

A dynamic vibration reducer 211 will now be explained with reference to FIGS. 24 to 27. A pair of dynamic vibration reducers 211 are provided in the body 103 in order to reduce vibration generated in the axial direction of the hammer bit during operation of the power tool. The dynamic vibration reducers 211 are arranged on the right and left sides of the outside surface of the gear housing 107 on the both sides of the axis of the hammer bit 119 (see FIG. 24). The dynamic vibration reducer 211 is shown by broken lines in FIGS. 21 to 23. The construction of the dynamic vibration reducer 211 is shown in detail in FIG. 25. FIGS. 26 and 27 are sectional views taken along line A-A and line B-B in FIG. 24. The right and left dynamic vibration reducers have the same construction. As shown in FIG. 25, each of the dynamic vibration reducers 211 mainly includes a cylindrical body 213 that is disposed adjacent to the body 103, a weight 215 that is disposed for vibration reduction within the cylindrical body 213, and biasing springs 217 that are disposed on the both sides of the weight 215 in the axial direction. The biasing springs 217 exert a spring force on the weight 215 in a direction toward each other when the weight 215 moves in the longitudinal direction of the cylindrical body 213 (in the axial direction of the hammer bit). The dynamic vibration reducer 211 having the above-described construction serves to reduce impulsive and cyclic vibration caused when the hammer bit 119 is driven. Specifically, the weight 215 and the biasing springs 217 serve as vibration reducing elements in the dynamic vibration reducer 211 and cooperate to passively reduce vibration of the body 103 of the hammer drill 101 on which a predetermined outside force (vibration) is exert. Thus, the vibration of the hammer drill 101 of this embodiment can be effectively alleviated or reduced.

Further, in the dynamic vibration reducer 211, a first actuation chamber 219 and a second actuation chamber 221 are defined on the both sides of the weight 215 in the axial direction within the cylindrical body 213. The first actuation chamber 219 normally communicates with the upper chamber 151*a* via a first communicating portion 219*a* (see FIGS. 24 and 26). As shown in FIG. 26, the first communicating portion 219*a* has a tubular member 219*b* that protrudes upward to a predetermined height in the upper chamber 151*a* and has a protruding end open to the upper chamber 151*a*. With this arrangement, lubricant within the upper chamber 151*a* is prevented from entering the first actuation chamber 219. The second actuation chamber 221 normally communicates with a cylinder accommodating space 223 of the gear housing 107 via a second communicating portion 221*a* (see FIGS. 24 and 27). The cylinder accommodating space 223 is not in communication with the upper chamber 151*a*. As mentioned above, the pressure within the upper chamber 151*a* fluctuates when the motion converting mechanism 113 is driven. Such pressure fluctuations are caused when the piston 129 forming the motion converting mechanism 113 linearly moves within the cylinder 141. The fluctuating pressure caused within the upper chamber 151*a* is introduced to the first actuation chamber 219 through the first communicating portion 219*a*, and the weight 215 of the dynamic vibration reducer 211 is actively driven. In this manner, the dynamic vibration reducer 211 performs a vibration reducing function. Specifically, the dynamic vibration reducer 211 serves as an active vibration reducing mechanism for reducing vibration by forced vibration in which the weight 215 is actively driven. Thus, the vibration which is caused in the body 103 during hammering operation can be further effectively reduced or alleviated.

Further, according to this embodiment, the rotation transmitting shaft 163, the third and fourth gears 164, 165 and the rotating member 166 which form the switching operation transmitting mechanism 169 for transmitting the switching operation of the mode switching member 155 to the rotating member 166 are disposed outside the driving section housing chamber 151. Therefore, the capacity of the driving section housing chamber 151 can be reduced by the capacity for housing these components of the switching operation transmitting mechanism 169. Further, with the construction in which the switching operation transmitting mechanism 169 is disposed outside the driving section housing chamber 151, the driving section housing chamber 151 can be partitioned into the upper chamber 151*a* and the lower chamber 151*b* such that the lower chamber 151*b* is held unaffected by the pressure fluctuations of the upper chamber 151*a*, or such that communication between the upper chamber 151*a* and the lower chamber 151*b* is substantially interrupted. As a result, the capacity of the upper chamber 151*a* is reduced. Thus, a wider range of pressure fluctuations (a higher rate of volumetric change of the upper chamber 151*a* which is caused by reciprocating movement of the piston 129) can be caused in the upper chamber 151*a* when the crank mechanism 114 is driven. As a result, in the construction in which the weight 215 of the dynamic vibration reducer 211 is actively driven by utilizing the pressure fluctuations in the upper chamber 151*a*, the effectiveness of reducing vibration of the body 103 by the dynamic vibration reducer 211 can be enhanced.

Further, with the construction in which switching of the clutch member 124 is effected by utilizing rotation of the rotating member 166, the opening 168 connecting the lower chamber 151*b* and the housing space 152 can be closed all the time by the rotating member 166. Thus, even in the construction in which the switching operation transmitting mechanism 169 is disposed outside the lower chamber 151*b*, switching of the clutch member 124 can be efficiently effected while avoiding the lubricant from leaking out of the lower chamber 151*b*.

Based on the above-described, following features can be made to define one of the aspects of the invention.

As to the power tool of claim 8, the driven-side rotating member may actuate a switching member for switching operation modes of the power tool by rotating around the driven shaft and the driven-side rotating member may have an eccentric pin extending along the direction of the driven shaft in a position displaced from the driven shaft. When the driven-side rotating member is cause to rotate by the driving-side rotating member, the eccentric pin may eccentrically revolve on the driven shaft and the driven-side rotating member actuates the operation mode switching member via components of the eccentric revolving movement in the direction crossing the driven shaft.

Further, as to the power tool of claim 9, the positioning member my have a positioning pin. And the relative positions of the positioning member with respect to the driving-side rotating member and the driven-side rotating member may be defined by using an axial end portion and an peripheral edge portion of the positioning pin, respectively.

DESCRIPTION OF NUMERALS

101 hammer drill (power tool)
103 body (power tool body)
105 motor housing
107 gear housing
107*a* pin
107*b* guide pin
109 handgrip
109*a* trigger
111 driving motor
113 motion changing mechanism
114 crank mechanism
115 striking mechanism
117 power transmitting mechanism
119 hammer bit (tool bit)
121 driving gear
123 driven gear
123*a* clutch teeth
124 clutch member
124*a* clutch teeth
124*b* flange
125 crank plate
126 biasing spring
127 crank arm
128 bearing
129 piston
132 intermediate gear
133 intermediate shaft
134 small bevel gear
135 large bevel gear
135*a* clutch teeth
141 cylinder
141*a* air chamber
143 striker
145 impact bolt
147 slide sleeve
147*a* clutch teeth
147*b* rotating locking teeth
147*c* stepped portion
148 biasing spring
149 lock ring
149*a* teeth
151 crank chamber
152 housing space
153 mode switching mechanism
155 mode switching member (switching member)
155*a* disc
155*b* operating grip
155*c* eccentric portion
157 first switching mechanism
159 second switching mechanism
161 first gear
162 second gear
163 rotation transmitting shaft (switching operation transmitting mechanism)
164 third gear
165 fourth gear
166 rotating member
167 first eccentric pin (actuating member)
168 opening
169 switching operation transmitting mechanism
173 frame member
173*a* base
173*b* leg
173*c* connecting pin
173*d* oblong hole
173*e* engagement end
175 second eccentric pin
181 first switching mechanism
183 swinging member (switching operation transmitting mechanism)
183*a* horizontal plate portion
183*b* vertical plate portion
183*c* slot
183*d* gear
183*e* guide groove
185 rotating member
185*a* circular gear
187 first eccentric pin

We claim:

1. A power tool comprising:

a power tool body;

a tool bit coupled to the power tool body, the tool bit performing a predetermined operation by linearly moving in an axial direction;

a motion converting mechanism housing chamber provided within the power tool body;

a motion converting mechanism that is disposed within the motion converting mechanism housing chamber and linearly moves the tool bit;

a clutch mechanism that is disposed within the motion converting mechanism housing chamber and is structured to be switched between a power transmission state in which a driving force is transmitted to the motion converting mechanism and a power transmission interrupted state in which transmission of the driving force is, interrupted;

a switching member that is disposed on an upper surface of the power tool body and is structured to be manually operated by a user to switch the operating state of the clutch mechanism;

an opening connecting the motion converting mechanism housing chamber and the outside;

a rotating member that is disposed outside the motion converting mechanism housing chamber and is structured to rotate while closing the opening; and a switching operation transmitting mechanism that is disposed outside the motion converting mechanism housing chamber, connects the switching member to the rotating member and transmits the switching operation effected by the user's manual operation of the switching member to the rotating member, wherein the rotating member includes an actuating member that extends into the motion converting mechanism housing chamber, and the actuating member switches the clutch mechanism between the power transmission state and the power transmission interrupted state by utilizing rotation of the rotating member.

2. The power tool as defined in claim 1, wherein the actuating member comprises an eccentric pin disposed in a position displaced from the axis of rotation of the rotating member and when the rotating member rotates, the eccentric pin eccentrically revolves on the axis of rotation of the rotating member and switches the state of the clutch mechanism by vertical components of the revolving movement.

3. The power tool as defined in claim 1, wherein the switching operation transmitting mechanism includes a rotating shaft member that is structured to rotate on an axis of rotation which is perpendicular to the axis of rotation of the rotating member, and the rotating shaft member and the rotating member are connected to each other by a plurality of bevel gears engaged with each other.

4. The power tool as defined in claim 1, wherein the switching operation transmitting mechanism includes a swinging member that is structured to swing on an axis of swinging movement which intersects with the axis of rotation of the rotating member, and wherein the swinging member includes a gear extending in the direction of the swinging movement of the swinging member, and the rotating member includes a circular gear, the swinging member and the rotating member being connected to each other by engagement of the gear and the circular gear.

5. The power tool as defined in claim 1 comprising:

a rotation driving mechanism that rotates the tool bit;

a clutch mechanism that is switched between a power transmission state in which a driving force is transmitted to the rotation driving mechanism and a power transmission interrupted state in which transmission of the driving force is interrupted; and a clutch switching mechanism that switches the clutch mechanism for the rotation driving mechanism between the power transmission state and the power transmission interrupted state according to the switching operation of the switching member, wherein:

the tool bit performs linear motion in the axial direction and rotation on the axis of the tool bit, the switching member comprises a mode switching member that switches among a hammer drill mode in which the tool bit is driven in combined movement of linear motion and rotation, a hammer mode in which the tool bit is driven solely by linear motion, and a drill mode in which the tool bit is driven solely by rotation, and when the switching member is turned to a hammer drill mode position, the clutch mechanism for the motion converting mechanism and the clutch mechanism for the rotation driving mechanism are both switched to the power transmission state; when the switching member is turned to a hammer mode position, the clutch mechanism for the motion converting mechanism is switched to the power transmission state, while the clutch mechanism for the rotation driving mechanism is switched to the power transmission interrupted state; and when the switching member is turned to a drill mode position, the clutch mechanism for the motion converting mechanism is switched to the power transmission interrupted state, while the clutch mechanism for the rotation driving mechanism is switched to the power transmission state.

6. The power tool as defined in claim 1, wherein the motion converting mechanism is provided with a crank mechanism and the motion converting mechanism housing chamber is provided with a crank chamber.

7. The power tool as defined in claim 1, wherein the switching operation transmitting mechanism comprises:

a driving-side rotating member having a driving shaft, the driving-side rotating member being inserted and mounted in the longitudinal direction of the driving shaft with respect to the power tool body so as to rotate on the driving shaft, a driven-side rotating member having a driven shaft, the driven-side rotating member being inserted and mounted in the longitudinal direction of the driven shaft with respect to the power tool body so as to rotate on the driven shaft and a single positioning member that defines an installation position of each of the rotating members within the power tool.

8. The power tool as defined in claim 7, wherein:

the driving-side rotating member and the driven-side rotating member are connected together in the state in which the driving shaft and the driven shaft cross each other, whereby a rotating force of the driving-side rotating member around the driving shaft is transmitted to the driven-side rotating member arranged crisscross with respect to the driving- side rotating member, so that a predetermined operation is performed, the positioning member allows the driving-side rotating member to be inserted and mounted in the power tool body only when the driving-side rotating member and the positioning member are placed in a predetermined relative position in the circumferential direction of the driving shaft, while the positioning member interferes with the driving-side rotating member and thus prevents the driving-side rotating member from being inserted and mounted in the power tool body when placed in a position other than the predetermined relative position, and the positioning member further allows the driven-side rotating member arranged crisscross with respect to the driving-side rotating member to be inserted and mounted in the power tool body only when the driven-side rotating member and the positioning member are placed in a predetermined relative position in the circumferential direction of the driven shaft, while the positioning member interferes with the driven-side rotating member and thus prevents the driven-side rotating member from being inserted and mounted in the power tool body when placed in a position other than the predetermined relative position.

9. The power tool as defined in claim 1, wherein the motion converting mechanism housing chamber comprises a crank chamber formed within the power tool body and a clutch chamber formed below the crank chamber within the power tool body and held unaffected by pressure fluctuations of the crank chamber when the crank mechanism is driven, and wherein the motion converting mechanism comprises a crank mechanism that is disposed within the crank chamber and linearly moves the tool bit and a clutch mechanism that is disposed within the crank chamber and is structured to be switched between a power transmission state in which a driving force is transmitted to the crank mechanism and a power transmission interrupted state in which transmission of the driving force is interrupted, the power tool further comprising a dynamic vibration reducer that reduces a vibration during operation of the tool bit, the dynamic vibration reducer having a weight that can linearly move in the axial direction of the tool bit while being acted upon by a biasing force of an elastic element, the weight being driven via pressure fluctuations caused within the crank chamber when the crank mechanism is driven.

* * * * *